US011993752B1

(12) United States Patent
Kumar et al.

(10) Patent No.: US 11,993,752 B1
(45) Date of Patent: May 28, 2024

(54) PROCESS FOR MANUFACTURING OF RENEWABLE HYDROCARBONS FROM RENEWABLE FEEDSTOCK COMPRISING PHOSPHORUS AS AN IMPURITY

(71) Applicant: Neste Oyj, Espoo (FI)

(72) Inventors: Hemanathan Kumar, Porvoo (FI); Satu Vatanen, Porvoo (FI); Ronny Wahlström, Porvoo (FI); Chunfen Jin, Porvoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 18/069,484

(22) Filed: Dec. 21, 2022

(51) Int. Cl.

| | |
|---|---|
| ***C10G 45/22*** | (2006.01) |
| ***C10G 45/72*** | (2006.01) |
| ***C10G 67/02*** | (2006.01) |

(52) U.S. Cl.
CPC ..... *C10G 45/22* (2013.01); *C10G 45/72* (2013.01); *C10G 67/02* (2013.01); *C10G 2300/1007* (2013.01); *C10G 2300/1014* (2013.01); *C10G 2300/1018* (2013.01); *C10G 2300/202* (2013.01)

(58) Field of Classification Search
CPC ..... C10G 45/22; C10G 45/72; C10G 67/02; C10G 2300/1007; C10G 2300/1014; C10G 2300/1018; C10G 2300/202
See application file for complete search history.

(56) References Cited

U.S. PATENT DOCUMENTS

| | | | |
|---|---|---|---|
| 7,232,935 | B2 | 6/2007 | Jakkula et al. |
| 7,459,597 | B2 | 12/2008 | Koivusalmi et al. |
| 7,850,841 | B2 | 12/2010 | Koivusalmi et al. |
| 8,022,258 | B2 | 9/2011 | Myllyoja et al. |
| 8,143,469 | B2 | 3/2012 | Koivusalmi et al. |
| 8,187,344 | B2 | 5/2012 | Jakkula et al. |
| 8,278,492 | B2 | 10/2012 | Myllyoja et al. |
| 8,394,258 | B2 | 3/2013 | Koivusalmi et al. |
| 8,592,638 | B2 | 11/2013 | Aalto et al. |
| 8,648,210 | B2 | 2/2014 | Hujanen et al. |
| 8,742,185 | B2 | 6/2014 | Ouni et al. |
| 8,815,198 | B2 | 8/2014 | Aittamaa et al. |
| 8,900,832 | B2 | 12/2014 | Kahelin et al. |
| 9,005,429 | B2 | 4/2015 | Markkanen et al. |
| 9,469,583 | B2 | 10/2016 | Hakola et al. |
| 9,545,621 | B2 | 1/2017 | Kettunen et al. |
| 10,370,317 | B2 | 8/2019 | Kettunen et al. |

(Continued)

*Primary Examiner* — In Suk C Bullock
*Assistant Examiner* — Jason Y Chong
(74) *Attorney, Agent, or Firm* — BUCHANAN INGERSOLL & ROONEY PC

(57) ABSTRACT

A method for preparing hydrocarbons includes subjecting a renewable feedstock comprising lipophilic phosphorus compounds to a hydrotreatment process to form hydrocarbons from the renewable feedstock. In some embodiments, the content of the lipophilic phosphorus compounds in the renewable feedstock can be in a range of between 2 parts per million by weight (wppm) and 0.1 wppm so that deactivation of a catalyst used in the hydrotreatment process is reduced or avoided. In some embodiments, a feedstock can be determined to include an amount of "difficult to remove" phosphorus and the result thereof can be used for selecting a suitable pretreatment to which the feedstock can then be subjected. The pretreated renewable feedstock can then be hydrotreated catalytically.

16 Claims, 5 Drawing Sheets

(56) References Cited

U.S. PATENT DOCUMENTS

| | | | |
|---|---|---|---|
| 10,501,693 | B2 | 12/2019 | Laakkonen et al. |
| 10,738,264 | B2 | 8/2020 | Bergström et al. |
| 10,954,451 | B2 | 3/2021 | Ouni et al. |
| 11,142,722 | B2 | 10/2021 | Malm |
| 11,427,782 | B2 | 8/2022 | Toukoniitty et al. |
| 11,485,924 | B2 | 11/2022 | Kiiski et al. |
| 2012/0116105 | A1 | 5/2012 | Aaltonen et al. |
| 2013/0199481 | A1 | 8/2013 | Rantanen-kolehmainen et al. |
| 2017/0137742 | A1 | 5/2017 | Heiska et al. |
| 2017/0145318 | A1 | 5/2017 | Myllyoja et al. |
| 2019/0203154 | A1* | 7/2019 | Malm ..... C11B 3/04 |
| 2020/0040277 | A1 | 2/2020 | Toukoniitty et al. |
| 2020/0040278 | A1 | 2/2020 | Malm et al. |
| 2020/0339895 | A1 | 10/2020 | Paasikallio et al. |
| 2020/0339911 | A1 | 10/2020 | Pasanen et al. |
| 2020/0362254 | A1 | 11/2020 | Nortio et al. |
| 2021/0269722 | A1 | 9/2021 | Touronen et al. |
| 2021/0292656 | A1 | 9/2021 | Touronen et al. |
| 2021/0292657 | A1 | 9/2021 | Toukoniitty et al. |
| 2022/0072446 | A1 | 3/2022 | Kuitunen et al. |
| 2022/0073840 | A1 | 3/2022 | Lindqvist et al. |
| 2022/0135891 | A1 | 5/2022 | Toukoniitty et al. |

* cited by examiner

PROCESS FOR MANUFACTURING OF RENEWABLE HYDROCARBONS FROM RENEWABLE FEEDSTOCK COMPRISING PHOSPHORUS AS AN IMPURITY

FIELD

The present disclosure generally relates to production of hydrocarbon compositions and the production of hydrocarbon compositions from impure or dirty feedstocks through catalytic conversion. Further, the present disclosure relates to analytic methods supporting the selection of one or more pretreatments to be used on at least one feedstock before use in a catalytic conversion process for formation of hydrocarbons.

BACKGROUND

Vegetable oils can be degummed to improve the quality of the oil (e.g., water, acid, enzymatic, and membrane degumming techniques can be used). Degumming or bleaching a vegetable oil for feeding that pretreated oil into a hydrotreatment process to folia hydrocarbons is disclosed, for example, in U.S. Pat. Nos. 8,742,185, 8,278,492, and 8,022,258.

As disclosed in U.S. Pat. No. 8,742,185, impurities present in renewable oil can be harmful for the performance of the hydrotreatment/deoxygenation catalyst used in hydrotreatment of a bio oil feedstock for formation of hydrocarbons. For instance, triglycerides can be converted to hydrocarbons through a hydrodeoxygenation pathway using classical hydrodesulphurisation (HDS) catalyst such as NiMo and CoMo HDS catalysts. However, the catalyst has been shown to be deactivated as a result of significant amounts of phosphorus in the feedstock.

SUMMARY

In renewable feedstocks used to form hydrocarbons, phosphorus can be an impurity that can deactivate hydrotreatment catalyst. Removal of this impurity can be performed to support a long lifetime for the hydrotreatment catalyst. For instance, the presence of phosphorus (P) in a feed fed to a hydrotreatment reactor can lead to catalyst deactivation and reactor plugging due to formation and precipitation of phosphate salts. We determined that, as the lipid feed pool for hydrocarbon production has been increasingly extended to lower quality wastes and residues, the phosphorus in a form resisting most common purification processes, hence so called "difficult to remove P", has been encountered, and identified as a potential issue affecting the hydrotreatment of feeds. This difficult to remove phosphorus has been determined to be present in an increasing number of feeds and quantities after we surprisingly recognized that this was an issue affecting feed quality and hydrotreatment performance. We were able to identify this difficult to remove phosphorus issue after we determined that the difficult to remove phosphorus was a result of lipophilic phosphorus compound(s) being present in a feed to be subjected to hydrotreatment when that feed had a cumulative content of lipophilic phosphorus compound(s) that was beyond an acceptable threshold.

The hydratability of phospholipids is a characteristic for the phospholipid compounds in the field of the fats and oils chemistry. We determined that the division of phospholipids into hydratable and non-hydratable phospholipids has practical importance for understanding how well a fat or oil can be purified in water degumming. There is some ambiguity in the division as adjusting the pH in the degumming alters the division into hydratable and non-hydratable phospholipids. The non-hydratable phospholipids may be considered as a part of lipophilic phosphorus compounds, but the concept of lipophilic phosphorus compounds accommodates a much broader chemical diversity than only phospholipids. Further, the concept of lipophilic phosphorus compounds is applicable to all types of lipid feeds and phosphorus impurities contained therein, also to such feeds that do not contain any phospholipids or derivatization or degradation products thereof.

Although phospholipids are the most discussed phosphorus impurities in oils and fats and formation of lipophilic phospholipid derivatives is, we believe, an anticipated route for lipophilic phosphorus, the concept of lipophilic phosphorus is by no means limited to phospholipid origins. As the waste and residue character of the feeds increases, the possibility for contamination by other, yet undefined phosphorus sources, which as such may be lipophilic, or after further degradation reaction diming treatment or logistics history of the lipid feed, may have become lipophilic although not originally having lipophilic precursors. Due to the lack of knowledge of the exact structures of many lipophilic phosphorus impurities, or the origin thereof, it is of high practical importance to be able to assess and quantify as a sum parameter these impurities, to be able to identify suitable industrial feeds with expected behavior of phosphorus purification challenges for catalytic hydrotreatment processing.

There is therefore a need to be able to assess and analyze lipophilic phosphorus compound(s) as impurities in feeds, to be able to identify suitable industrial feeds with expected behavior as to phosphorus compounds. Additionally, there is a need for reasoned selection of pretreatments to remove, minimize or at least control the amount of lipophilic phosphorus compound(s) therein.

According to a first aspect, a process for producing renewable hydrocarbons suitable for use in fuel applications and biochemical applications (e.g. formation of chemicals of a biological origin) from a renewable feedstock comprising at least one or more lipophilic phosphorus compound(s) is provided. The process can include:

(i) providing the renewable feedstock, wherein the sum amount of the lipophilic phosphorus compound(s) calculated as elemental phosphorus is more than 2 parts per million by weight (wppm) 2 wppm, preferably from 2 wppm to 50 wppm, preferably from 2 to 30 wppm of the total feedstock weight;

(ii) subjecting the renewable feedstock to at least one pretreatment to obtain a pretreated renewable feedstock, wherein the sum amount of the lipophilic phosphorus compound(s) calculated as elemental phosphorus is less than 2 wppm, such as from 2 wppm to 0.1 wppm, 2 wppm to 0.2 wppm, 2 wppm to 0.3 wppm, or 2 wppm to 0.4 wppm, of the pretreated renewable feedstock weight;

(iii) subjecting the pretreated renewable feedstock to at least one catalytic hydrotreating step to obtain the renewable hydrocarbons.

Preferably said steps are conducted in sequence (i), (ii), (iii). It has been surprisingly found that embodiments of the process can provide less deposit formation on catalysts in prolonged uses that have enhanced catalyst lifetime.

According to a second aspect, a process for use of a separation and an analysis in catalytic production of renewable hydrocarbons to provide data on at least one lipophilic phosphorus compound(s) in a renewable feedstock is provided. The process can also include use of the separation and analysis for selection of a pretreatment capable of reducing the lipophilic phosphorus compound(s) content beyond a pre-selected level (e.g. keeping this content at or below a pre-selected threshold or within a pre-selected content range) and subjecting the renewable feedstock to the selected pretreatment to provide a pretreated renewable feedstock.

It has been surprisingly found that the process of the second aspect can provide better control on the catalytic process by hydrotreating feedstocks with sufficiently low amount of lipophilic phosphorus compound(s) where the selected pretreatment was selected based on the data obtained through said separation and analysis.

Commonly for said first and second aspects, the embodiments of our processes can provide a means for selecting a suitable pretreatment or a combination of pretreatments for a feedstock by knowledge of the content of the lipophilic phosphorus compound(s) instead of the total phosphorus content, as evidenced by the results shown in the Examples.

A method for preparing hydrocarbons is provided that can include subjecting a renewable feedstock comprising lipophilic phosphorus compounds to a hydrotreatment process to form hydrocarbons from the renewable feedstock. A content of the lipophilic phosphorus compounds in the renewable feedstock can be in a range of between less than 2 parts per million by weight (wppm) and 0.1 wppm (e.g. 1.5 wppm to 0.1 wppm, less than 2 wppm to less than or equal to 0.2 wppm, etc.) so that deactivation of a catalyst used in the hydrotreatment process is reduced or avoided.

Embodiments of the method can include additional steps. For instance, the method can also include evaluating the renewable feedstock before the renewable feedstock is subjected to the hydrotreatment process to determine the content of the lipophilic phosphorus compounds in the renewable feedstock. In response to a determination that the content of the lipophilic phosphorus compounds in the renewable feedstock is greater than a pre-selected lipophilic phosphorus content threshold, renewable feedstock can be pretreated via at least one pretreatment process to lower the content of the lipophilic phosphorus compounds within the renewable feedstock so the content of the lipophilic phosphorus compounds in the renewable feedstock is less than 2 wppm and greater than or equal to 0.1 wppm or is less than 1.5 wppm and greater than or equal to 0.1 wppm.

In some embodiments, the pre-selected lipophilic phosphorus content threshold can be less than 2 wppm lipophilic phosphorus content or 2 wppm lipophilic phosphorus content. In other embodiments, the pre-selected lipophilic phosphorus content threshold can be 5 wppm lipophilic phosphorus content or a value that is within a range of 50 wppm and 2 wppm lipophilic phosphorus content. Yet other embodiments can utilize a different threshold value that may be suitable for a particular set of design criteria (e.g. a value in a range of 30 wppm to 2 wppm lipophilic phosphorus content, a value within a range of 5 wppm and 2 wppm lipophilic phosphorus content, etc.).

The at least one pretreatment process can include degumming, heat treatment, acid treatment, filtration, bleaching, heat treatment with adsorbent (HTA), blending or any combination thereof. In some embodiments, the at least one pretreatment process can include heat treatment followed by bleaching, bleaching followed by heat treatment, and/or heat treatment and bleaching being performed on at least a portion of feed prior to that portion of the feed being blended with other feed to form a pretreated feedstock for undergoing hydrotreatment. Other embodiments can utilize other combinations of pretreatment as well.

In some embodiments, the renewable feedstock can be considered a first renewable feedstock. In such embodiments, the method can also include evaluating a second renewable feedstock before the first renewable feedstock is subjected to the hydrotreatment process to determine the content of the lipophilic phosphorus compounds in the second renewable feedstock. In response to a determination that the content of the lipophilic phosphorus compounds in the second renewable feedstock is greater than a pre-selected lipophilic phosphorus content threshold, the second renewable feedstock can be blended with at least one third renewable feedstock to form a blended renewable feedstock so the content of the lipophilic phosphorus compounds in the blended renewable feedstock is lower than the content of the lipophilic phosphorus compounds in the second renewable feedstock and is at or below the pre-selected lipophilic phosphorus contend threshold and/or the second renewable feedstock or the blended renewable feedstock can be pretreated to lower the content of the lipophilic phosphorus compounds therein. The blending and/or pretreating can be performed to form the first renewable feedstock for subjecting the first renewable feedstock to the hydrotreatment process.

Embodiments of the method can also include analyzing of the content of the lipophilic phosphorus compounds in the renewable feedstock. The analyzing of the content of the lipophilic phosphorus compounds in the renewable feedstock can include collecting at least one sample of the renewable feedstock, separating from the sample at least one fraction including the lipophilic phosphorus compounds, and analyzing the at least one fraction to provide data on the content of the lipophilic phosphorus compounds in the renewable feedstock.

The separating from the sample at least one fraction including the lipophilic phosphorus compounds can include solid phase extraction (SPE) in some implementations. The separating from the sample can be performed such that at least one amphiphilic fraction is also collected. The SPE can include use of a solvent system such that a polarity of solvents in the solvent system increases during the SPE.

The analyzing of the at least one fraction including the lipophilic phosphorus compounds can include one or more of: a quantitative analysis to provide quantitative data on lipophilic phosphorus compounds, a quantitative mass spectrometry analysis, and/or an inductively coupled plasma mass spectrometry analysis.

Embodiments of the method can also include evaluating the renewable feedstock before the renewable feedstock is subjected to the hydrotreatment process to determine the content of lipophilic phosphorus compounds in the renewable feedstock. In response to a determination that the content of the lipophilic phosphorus compounds in the renewable feedstock is greater than a pre-selected lipophilic phosphorus content threshold, at least one pretreatment process can be selected to pretreat the renewable feedstock to lower the content of the lipophilic phosphorus compounds within the renewable feedstock so the content of the lipophilic phosphorus compounds in the renewable feedstock is less than 2 wppm and greater than or equal to 0.1 wppm. The selecting of the at least one pretreatment process can be based on results from the evaluating of the renewable feedstock.

It should be appreciated that a hydrotreatment process can include one or more of hydrodeoxygenation, hydrodecarboxylation, hydrodecarbonylation, hydroisomerisation and hydrocracking. A catalyst can be utilized in the hydrotreatment process.

Embodiments of a system for preparing hydrocarbons is also provided. Embodiments of the system can include a vessel for storage of a renewable feedstock comprising lipophilic phosphorus compounds and a hydrotreatment reactor positioned to receive the renewable feedstock from the vessel such that the renewable feedstock fed to the hydrotreatment reactor is subjectable to a hydrotreatment process to form hydrocarbons in a catalytic reaction employing a catalyst. A content of the lipophilic phosphorus compounds in the renewable feedstock subjectable to the hydrotreatment process can be in a range of less than 2 parts per million by weight (wppm) and greater than or equal to 0.1 wppm so that deactivation of the catalyst is reduced or avoided.

It should be appreciated that the vessel can include a single vessel or can include multiple vessels. In some embodiments, each vessel can retain a different renewable feedstock when more than one vessel is provided.

Embodiments of the system can also include at least one pretreatment device positioned between the vessel and the hydrotreatment reactor to pretreat the renewable feedstock via at least one pretreatment process to lower the content of the lipophilic phosphorus compounds within the renewable feedstock before the renewable feedstock is passed to the hydrotreatment reactor. In some embodiments, there can be a single pretreatment device. other embodiments may utilize two pretreatment devices or more than two pretreatment devices. The at least one pretreatment device can be positioned and configured to perform one or more of: degumming, heat treatment, acid treatment, filtration, bleaching, HTA, and/or blending.

A renewable feedstock for being subjected to a hydrotreatment process to form hydrocarbons is also provided. The feedstock can include a renewable feedstock formed from at least one renewable source. The renewable feedstock can include lipophilic phosphorus compounds. A content of the lipophilic phosphorus compounds in the renewable feedstock can be in a range of less than 2 wppm and greater than or equal to 0.1 wppm so that deactivation of catalyst used in the hydrotreatment process is reduced or avoided.

In some embodiments, the at least one renewable source can include one or more of: rapeseed oil, colza oil, canola oil, tall oil, sunflower oil, soybean oil, hempseed oil, cottonseed oil, corn oil, olive oil, linseed oil, mustard oil, palm oil, peanut oil, castor oil, coconut oil, camellia oil, jatropha oil, an oil derived from a microbial source, animal fat, fish oil, lard, tallow, train oil, oil derived from bacteria, oil derived from mold, oil derived from filamentous fungi, recycled fat from at least one industrial food source, and a mixture thereof.

A method for selecting a renewable feedstock for use in forming hydrocarbons or biochemicals is also provided. Embodiments of the method can include evaluating the renewable feedstock before the renewable feedstock is acquired for use in a hydrotreatment process to form the hydrocarbons. The evaluating can be performed to determine a content of lipophilic phosphorus compounds in the renewable feedstock. In response to a determination that the content of the lipophilic phosphorus compounds in the renewable feedstock is greater than a pre-selected lipophilic phosphorus content threshold, the renewable feedstock can be evaluated to determine whether it is pretreatable to lower the content of the lipophilic phosphorus compounds within the renewable feedstock so the content of the lipophilic phosphorus compounds in the renewable feedstock is in a range of less than 2 wppm and greater than or equal to 0.1 wppm. In response to determining that the renewable feedstock is pretreatable to lower the content of the lipophilic phosphorus compounds in the renewable feedstock to within the range of less than 2 wppm and greater than or equal to 0.1 wppm, the feedstock can be accepting or acquired for use in a process to form the hydrocarbons. In situations where it is not able to be effectively pretreated, the feedstock may be rejected.

Embodiments of the method can also include pretreating the renewable feedstock via one or more of: degumming, heat treatment, acid treatment, filtration, bleaching, HTA, blending or any combination thereof. The pretreating can be selected based on the evaluation of the lipophilic phosphorus content of the feedstock.

In some implementations, the evaluated renewable feedstock can be considered a first renewable feedstock and the method can also include evaluating a second renewable feedstock before the first renewable feedstock is subjected to a hydrotreatment process to determine a content of lipophilic phosphorus compounds in the second renewable feedstock. In response to a determination that the content of the lipophilic phosphorus compounds in the second renewable feedstock is less than a pre-selected lipophilic phosphorus content threshold the second renewable feedstock can be blended with the first renewable feedstock to form a blended renewable feedstock so the content of the lipophilic phosphorus compounds in the blended renewable feedstock is lower than the content of the lipophilic phosphorus compounds of the first renewable feedstock and the content of the lipophilic phosphorus compounds in the blended renewable feedstock is at or below the pre-selected lipophilic phosphorus content threshold for forming a hydrotreatment feed to feed to a hydrotreatment process, or the first renewable feedstock can be pretreated to lower the content of the lipophilic phosphorus compounds therein for subsequent blending with the second renewable feedstock for forming a hydrotreatment feed to feed to a hydrotreatment process where the hydrotreatment feed has a content of the lipophilic phosphorus compounds therein that is at or below the pre-selected lipophilic phosphorus content threshold.

It should be appreciated that the pretreating of the first renewable feedstock can include degumming, heat treatment, acid treatment, filtration, bleaching, HTA, or any combination thereof.

In some embodiments, the evaluating the renewable feedstock can include analyzing the content of the lipophilic phosphorus compounds in the renewable feedstock. The analyzing can include collecting at least one sample of the renewable feedstock and separating from the sample at least one fraction including the lipophilic phosphorus compounds. The separating from the sample at least one fraction including the lipophilic phosphorus compounds can include solid phase extraction (SPE). The separating from the sample can be performed such that at least one amphiphilic fraction is also collected. The SPE can include use of a solvent system such that a polarity of solvents in the solvent system increases during the SPE. The analysis can also include analyzing the at least one fraction to provide data on the content of the lipophilic phosphorus compounds in the renewable feedstock. This analysis of the at least one fraction can include at least one of: a quantitative analysis to provide quantitative data on the lipophilic phosphorus compounds; a quantitative mass spectrometry analysis, and/or an inductively coupled plasma mass spectrometry analysis.

Embodiments can also include a process for producing renewable hydrocarbons suitable for use in fuel applications from a renewable feedstock comprising at least one or more lipophilic phosphorus compound(s). The process can include providing the renewable feedstock wherein the sum amount of the lipophilic phosphorus compound(s) calculated as elemental phosphorus is more than 2 wppm, preferably from more than 2 wppm to 50 wppm, of the total renewable feedstock weight. The renewable feedstock can also be subjected to at least one pretreatment to obtain a pretreated renewable feedstock wherein the sum amount of the lipophilic phosphorus compound(s) calculated as elemental phosphorus is less than 2 wppm, preferably less than 1.5 wppm, of the pretreated renewable feedstock weight. The pretreated renewable feedstock can be subjected to at least one catalytic hydrotreating step to obtain the renewable hydrocarbons.

Embodiments of systems can be provided to implement one or more embodiments of the method or process. Embodiments of the system can include at least one vessel for storage of a feed, at least one pretreatment device for pretreatment of the feed, and at least one hydrotreatment reactor for hydrotreatment of the pretreated feed. Embodiments can also utilize one or more sample extraction mechanisms for extraction of samples for analysis of lipophilic phosphorus content within the samples. Pretreatment utilization and/or selection can be based on the analysis of the extracted samples.

Other details, objects, and advantages of the invention will become apparent as the following description of certain exemplary embodiments thereof and certain exemplary methods of practicing the same proceeds.

BRIEF DESCRIPTION OF THE DRAWINGS

Some example embodiments will be described with reference to the accompanying figures, in which.

DETAILED DESCRIPTION

Figure 1:
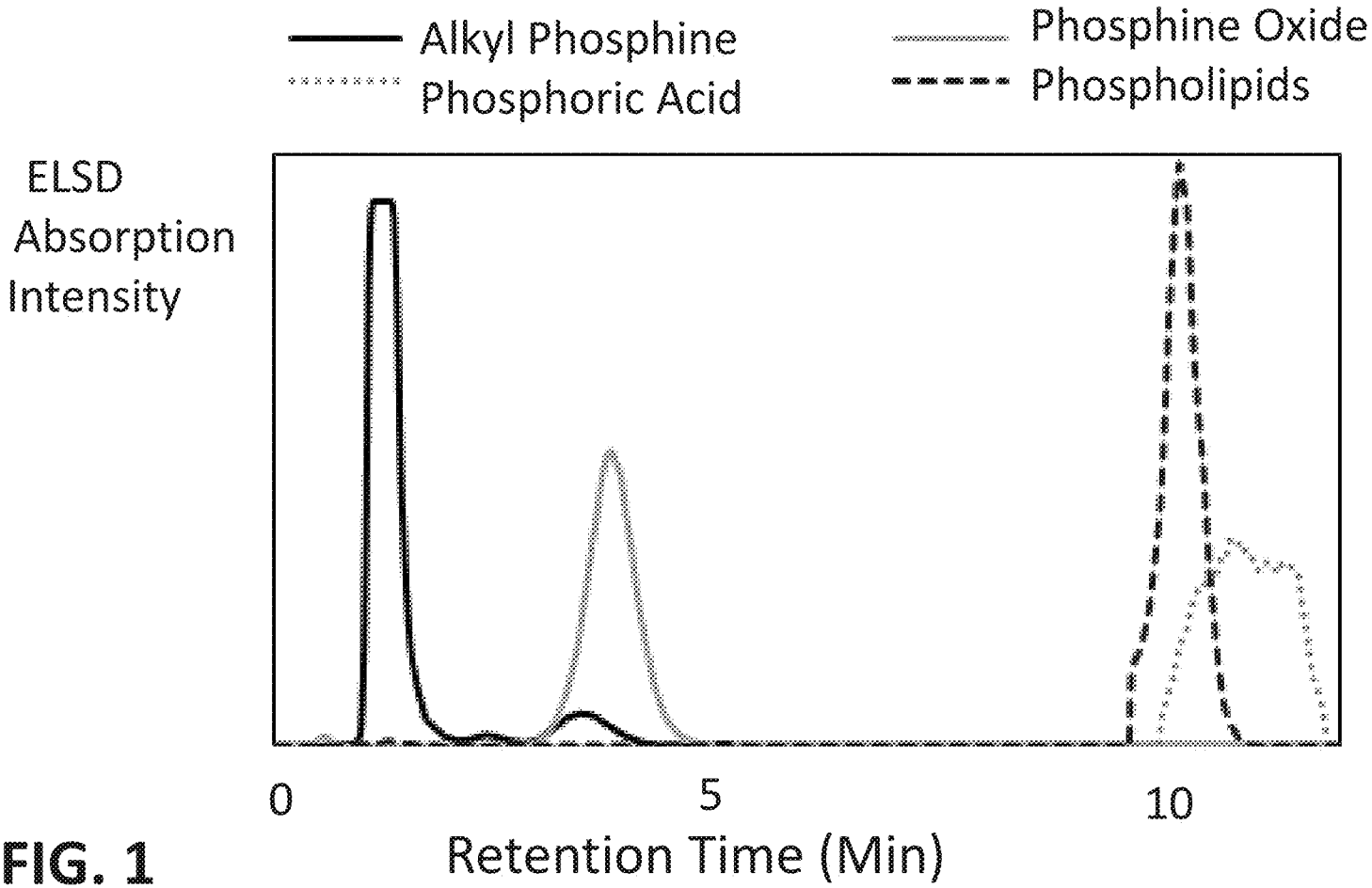
FIG. 1 shows Lipophilic phosphorus (A and B) and amphiphilic phosphorus (C and D) model compound separation results by an SPE method plotting absorption intensity as a function of retention time.

In the following description, like reference signs denote like elements or steps. All standards referred to herein are the latest revisions available at the filing date, unless otherwise mentioned.

When addressing phosphorus (P) generally in this context, it is understood to encompass any compounds containing at least one phosphorus atom. In relation to analyses, such as total phosphorus content, it is expressed and calculated as elemental phosphorus. However, it is understood that in the feedstocks of interest phosphorus is bound to inorganic, and organic compounds, the structure and characteristics of which depend on the feedstock type and origin. Standard methods for determining the total phosphorus content in a sample are known. For oil or fat sample an example of such a method can include inductively Coupled Plasma (ICP) based determinations, an example of which is ISO 10540-3:2002.

By lipophilic phosphorus compounds (which is what we believe is the difficult to remove phosphorus compounds discussed above), is meant herein phosphorus containing impurities that are not efficiently removed, or are only marginally removed, in conventional surface chemistry treatments such as degumming or bleaching. Even increasing adsorbent dosage or performing multiple bleaching steps in sequence will not improve purification to a desired level.

Without being bound by any theory it is anticipated that on the molecular level, it is likely that difficult to remove phosphorus has been formed by different pathways from different precursor molecules, meaning that difficult to remove phosphorus can encompass an array of molecules containing phosphorus that are difficult to remove. Lipophilic phosphorus can be derived from various origins and could also be for example an added phosphorus chemical, which is lipophilic. Structurally, it is believed that the difficult to remove phosphorus is lipophilic (e.g. it prefers staying in the lipid phase rather than going into a water phase or settling on the phase interfaces). Lipophilic phosphorus impurities may be chemically formed or transfouned from originally amphiphilic compounds by the loss of the polar head groups, or they may become masked by structures of non-polar, organic character. By losing the molecule's amphiphilic properties, it is not anymore surface active and will not be susceptible to removal by surface phenomena, like micelle/gum formation in degumming, or adsorption in bleaching, and hence is not removed by methods based on surface phenomena. The "lipophilic phosphorus compound(s)" refers herein to phosphorus derivatives that in an immiscible oil-water system or adsorbent-oil system, stay in the oil phase. Said lipophilic phosphorus compound(s) essentially show no interfacial surface activity to the oil phase interfaces under conditions which are typical for industrial degumming or bleaching processes.

When assessed quantitatively, in a stream, such as feedstock or pretreated feedstock, the amount of lipophilic phosphorus compound(s) may be expressed and calculated as elemental phosphorus per the total sample weight or volume (e.g., such as a lipophilic fraction collected by SPE, etc.). Even though it is understood that different compounds are present, the identification of said compounds or knowing their individual amounts is secondary to the need to determine the sum amount of all lipophilic phosphorus compound (s) present. Hence, when referring to the amount of lipophilic phosphorus compound(s), it means said sum amount. For some purposes, it may be relevant to assess difference between treated and untreated sample and/or the ratio between the content of the lipophilic phosphorus compounds and the total phosphorus content. In the experiments conducted, the solid phase extraction method provided at least one lipophilic and at least one amphiphilic fraction, each containing phosphorus compounds confirming the difference between phosphorus compounds having both lipophilic and hydrophilic parts in contrast to the lipophilic phosphorus compounds lacking hydrophilic heads. Of these, the lipophilic phosphorus compound(s) were recovered in the lipophilic fraction(s) only and not in the amphiphilic fraction(s). Hence, analysis on said lipophilic fraction(s) can provide qualitative and quantitative information on the lipophilic phosphorus compound(s) in the feed in question.

Analysis before and after a pretreatment can provide information on the effect of said pretreatment.

Typically, the feedstocks as used herein refer to renewable feedstocks e.g., feedstocks derived from raw material of biological origin. The sources for renewable feedstock are numerous including oils and/or fats, usually containing lipids (e.g., fatty acids or glycerides), such as plant oil/fats, vegetable oil/fats, animal oil/fats, algae oil/fats, fish oil/fats and algae oil/fats, or oil/fats from other microbial processes, for example, genetically manipulated algae oil/fats, genetically manipulated oil/fats from other microbial processes and also genetically manipulated vegetable oil/fats. Components derived from these materials may also be used, for example, alkyl esters, typically C1-C5 alkyl esters, such as methyl, ethyl, propyl, iso-propyl, butyl, sec-butyl esters, or olefins. Additionally, the renewable feedstock may include C1-C5 alkyl alcohols, particularly methyl, ethyl, propyl, iso-propyl, butyl, and/or sec-butyl esters of fatty acids, and any combinations thereof.

The renewable feedstock may additionally include free fatty acids, fatty acid esters (including mono-, di-, and triglycerides), or combinations thereof. For example, the free fatty acids may include free fatty acids obtained by stripping free fatty acids from a triglyceride transesterification feedstock. The renewable feedstock may include the fatty acid distillate from vegetable oil deodorization.

Plant and/or vegetable oils and/or microbial oils may include babassu oil, carinata oil, soybean oil, canola oil, coconut oil, rapeseed oil, crude tall oil (CTO), tall oil (TO), tall oil fatty acid (TOFA), tall oil pitch (TOP), palm oil (PO), palm oil fatty acid distillate (PFAD), jatropha oil, palm kernel oil, sunflower oil, castor oil, camelina oil, archaeal oil, bacterial oil, fungal oil, protozoal oil, algal oil, seaweed oil, oils from halophiles, and mixtures of any two or more thereof. Animal fats and/or oils may include inedible tallow, edible tallow, technical tallow, floatation tallow, lard, poultry fat, poultry oils, fish fat, fish oils, and mixtures of any two or more thereof. Greases may include yellow grease, brown grease, waste vegetable oils, restaurant greases, trap grease from municipalities such as water treatment facilities, and spent oils from industrial packaged food operations, and mixtures of any two or more thereof. In the context of the present disclosure, the feedstocks are typically low grade and contain various impurities such as waste and residues, materials not suitable for food, feed, or cosmetic applications.

According to an embodiment, the renewable feedstock comprises at least one of acidulated soapstock, (ASK), poultry fat, dry rendered poultry fat (AFP), brown grease (BG), used cooking oil (UCO), tall oil, fraction of tall oil, crude tall oil (CTO), tall oil pitch (TOP), palm oil mill effluent (POME), crude palm oil (CPO), palm oil, palm seed oil, palm fatty acid distillate (PFAD), babassu oil, carinata oil, coconut butter, muscat butter oil, sesame oil, maize oil, poppy seed oil, cottonseed oil, soy oil, laurel seed oil, jatropha oil, palm kernel oil, camelina oil, archaeal oil, bacterial oil, fungal oil, protozoal oil, algal oil, seaweed oil, mustard seed oil, oils from halophiles, soybean oil (SBO), technical corn oil, rapeseed oil (RSO), colza oil, canola oil, sunflower oil, hemp seed oil, olive oil, linseed oil, mustard oil, peanut oil, castor oil, coconut oil, lard, tallow, train oil, spent bleaching earth oil (SBEO), lignocellulosic based feeds, or any mixture thereof.

In these feeds, some phosphorous compounds have been shown to be difficult to remove with common purification methods finding basis on surface chemistry and hence pose additional challenges. The waste and residue materials actually contain a wide variety of lipophilic phosphorus compound. Animal fats, as a specific feedstock, comprise membrane residues etc. which have proven to be difficult to be removed from the feedstock stream.

The main source of phosphorus in bio oils are phospholipids and inorganic phosphates, which especially in animal fats that can originate from bone meal. In addition, there may be some minor amounts of phosphorus impurities from other sources, e.g. DNA, RNA and ATP, and further the processing of the fat or oil may have promoted the formation of different types of organic phosphorus compounds, the identity of which are not known and which are hard to remove by degumming or bleaching. Phospholipids are generally removed by degumming and further residual phospholipids can be adsorbed in the adsorption step in many bleaching sequences (the degumming mechanism also takes part in many bleaching sequences). Heat treatment has been found very efficient for degrading phospholipids (heat sensitive) so that they can be removed by filtering or bleaching. Phosphate in bone meal is generally present as solid particles and is removed by filtration e.g. in bleaching.

The oils and/or fats of biological origin may include a single kind of oil, a single kind of fat, mixtures of different oils, mixtures of different fats, mixtures of oil(s) and fat(s), fatty acids, glycerol, and/or mixtures of the afore-mentioned. Typically, when waste and residue material are used, they comprise mixtures of several components and accordingly, a miscellaneous range of varying lipophilic phosphorus compounds as impurities.

Fats, oils, and greases as feedstock may also contain further impurities, such as metals, mainly sodium, potassium, magnesium, calcium, iron, and copper or combinations thereof. The common pretreatments based on surface chemistry are typically able to lower the amount of the metal impurities. The feeds may further contain several heteroatoms, such as Cl, S and N in varying amounts, occasionally even high amounts, depending on the origin of the feed. Heteroatoms can normally be handled by the available pretreatment methods or processing sequences as well.

The typical way of handling undesirable impurities in feedstocks, such as phosphorus impurities, is to pretreat the feedstock prior to hydrotreatment. It is simple to remove the water-soluble phosphorus compounds, such as inorganic or amphiphilic phosphorus through degumming. However, in certain animal fats, a significant part of the phosphorus compounds are lipophilic phosphorus compounds, and much more difficult to reduce or remove than the water-soluble or amphiphilic phosphorus compounds.

In the context of the present disclosure, hydrotreating is considered as the "main process" for the conversion of the feed into products (e.g., hydrocarbons, biochemicals, etc.). Therefore, one or more treatments to which the renewable feedstock is subjected to for lowering the lipophilic phosphorus content within the feed prior to that feed undergoing hydrotreatment is referred as at least one pretreatment and/or a plurality of pretreatments (e.g., a first pretreatment, a first pretreatment and a second pretreatment, etc.).

Hydrotreatment refers to hydrodeoxygenation, hydrodesulfurisation, hydrodenitrogenation, hydrodehalogenation (such as hydrodechlorination), hydrogenation of double bonds, hydrocracking, hydroisomerisation, any combination thereof and it also removes some metals. According to an embodiment, the catalytic hydrotreating comprises one or more of hydrodeoxygenation, hydroisomerisation and hydrocracking, simultaneously or in sequence. It is common, that even though the main reaction is one of the above mentioned, further reactions take place as side reactions.

Hence, some decarboxylation and/or decarbonylation might also appear. When aiming at fuel and/or biochemical production, typical sequences of hydrotreatment reactions are hydrodeoxygenation followed by hydroisomerisation, hydrodeoxygenation followed by hydrocracking and hydroisomerisation or hydrodeoxygenation followed by hydroisomerisation and hydrocracking.

According to an embodiment, the pretreated renewable feedstock is subjected to hydrotreating in the presence of a catalyst selected from Pd, Pt, Ni, Co, Mo, Ru, Rh, W, or any combination of these, such as CoMo, NiMo, CoNiMo, NiMoW, or together with SAPO-11, SAPO-41, ZSM-22, ZSM-23, ZSM-12, ZSM-48, ZSM-5, beta zeolites, ferrierite, and mixtures thereof, such as Pt/SAPO-11/$Al_2O_3$, Pt/ZSM-22/$Al_2O_3$, Pt/ZSM-23/$Al_2O_3$, Pt/SAPO-11/$SiO_2$, optionally on a support, wherein the support is preferably alumina and/or silica (e.g. $Al_2O_3$ and/or $SiO_2$), and a liquid product comprising renewable hydrocarbons is recovered. Said catalysts can lose their activity if phosphate compounds, such as salts, form and precipitate thereon. Therefore, removal of lipophilic phosphorus compounds can contribute to catalyst lifetime enhancement Avoiding catalyst deactivation (e.g. the loss over time of catalytic activity and/or selectivity), is a continuing aim in industrial catalytic processes. Costs to industry for catalyst replacement and process shutdown add up into considerable economic losses per year. Time scales for catalyst deactivation may vary considerably depending on the process and the catalyst types used. Some catalysts last for a few seconds whereas some may last for tens of years. Nevertheless, it is inevitable that all catalysts will eventually deactivate. Typically, the loss of activity and/or selectivity in a well-controlled process occurs slowly. However, process upsets or poorly designed hardware can bring about unexpected and early failures. While catalyst deactivation is inevitable for most processes, some of its drastic consequences may be avoided and at least postponed by embodiments of our process and system.

Deactivation of a catalyst as discussed herein can refer to the gradual deterioration of the performance of the catalyst, which eventually reaches a level wherein it is no longer reasonable to continue the use of the catalyst. In this context reasonableness is best depicted by the ability to produce the product that fulfils the predefined quality and quantity criteria. In practice this means that each catalyst will confront a point of time when it is deactivated to an extent requiring a change of the spent catalyst to a fresh one. Thus, the deactivation can be described as the catalyst lifetime length per shutdown frequency. This ratio can provide a measure for the ability to produce the final product in view of the needed shutdowns for a catalyst change due to deactivation. In other words, less production is lost in a given time frame if there are fewer shutdowns due to catalyst changes originating from catalyst deactivation.

Deactivation of the catalyst is typically defined as impurities residing on a catalyst surface, thus blocking the active sites of the catalyst from the feedstock molecules. Deactivation of the catalyst can be caused by fouling or poisoning of the catalyst. Fouling is generally considered to be related to deposition of insoluble components present in the feed or formed by degradation of the feed or reaction intermediates, whereas poisoning is related to the deposition of electropositive contaminants, such as alkali and alkaline earth metals, on acid sites or electronegative contaminants at hydrogenation sites. The hydrodeoxygenation is preferably the first catalytic hydrotreatment in a sequence of hydrotreatments and conducted in the presence of a hydrodeoxygenation catalyst selected from Pd, Pt, Ni, Co, Mo, Ru, Rh, W, or any combination of these, such as CoMo, NiMo, NiW, CoNiMo, on a support, wherein the support is preferably alumina and/or silica.

The hydrodeoxygenation may take place at reaction conditions comprising a temperature in the range from 100° C. to 500° C., preferably from 250° C. to 400° C., more preferably from 280° C.-350° C., most preferably at temperature of 300° C.-330° C. The hydrodeoxygenation may take place at reaction conditions comprising a pressure in the range from 0.1 MPa to 20 MPa, preferably from 0.2 MPa to 8 MPa.

Preferably, the weight hourly space velocity (WHSV) in the hydrodeoxygenation reaction a is in the range from 0.5 h-1 to 3.0 h-1, more preferably from 1.0 h-1 to 2.5 h-1, most preferably from 1.0 to 2.0 h-1. Preferably, hydrogen ($H_2$) flow is in the range from 350 nl $H_2$/l feed to 900 nl $H_2$/l feed, more preferably from 350 nl $H_2$/l to 750 nl $H_2$/l, most preferably from 350 nl $H_2$/l to 500, nl $H_2$/l wherein nl $H_2$/l means normal liters of hydrogen per liter of the feed into the HDO reactor, in the presence of a hydrodeoxygenation catalyst.

Hydrotreating may comprise hydrodeoxygenation and hydroisomerisation, simultaneously or in sequence. In a specific embodiment, hydrodeoxygenation and hydroisomerisation are performed simultaneously using a NiW catalyst.

When the pretreated feedstock is first subjected to HDO, the liquid product recovered therefrom is (in accordance with a preferred sequence for a hydrotreatment) next subjected to hydroisomerisation to produce branched paraffinic hydrocarbons. The hydroisomerisation is conducted in the presence of an hydroisomerisation catalyst containing a support, a metal and a further catalyst material, said support selected from $Al_2O_3$ and $SiO_2$, and said metal selected from Pt and Pd and Ni, and said further catalyst material selected from SAPO-11, SAPO-41, ZSM-22, ZSM-23, ZSM-12, ZSM-48, ZSM-5, beta zeolites and mixtures thereof. Such catalyst materials have been found to deactivate if lipophilic phosphorus compounds are not effectively removed to keep the lipophilic phosphorus content within a pre-selected range or at or below a pre-selected threshold, which deactivation may be at least partly prevented by pretreatment (e.g. in accordance with embodiments discussed herein, etc.).

The hydroisomerisation step is preferably performed at a temperature from 250° C. to 400° C., more preferably from 280° C. to 370° C., most preferably from 300° C. to 350° C. The hydroisomerisation may take place at reaction conditions comprising a pressure, which preferably is from 1 MPa to 6 MPa, more preferably from 2 MPa to 5 MPa, most preferably from 2.5 MPa to 4.5 MPa.

The hydrodeoxygenation may take place at reaction conditions comprising a WHSV preferably from 0.5 h-1 to 3 h-1, more preferably from 0.5 h-1 to 2 h-1, most preferably from 0.5 h-1 to 1 h-1, and $H_2$ flow as in-liter Hz/liter feed, preferably from 100 h-1 to 800 h-1, more preferably from 200 h-1 to 650 h-1, most preferably from 350 h-1 to 500 h-1.

The isomerization treatment is a step which predominantly serves to isomerize at least part of the hydrodeoxygenated raw material. That is, while most thermal or catalytic conversions (such as HDO) result in a minor degree of isomerization (usually less than 5 weight percent (wt %, wt-%, or %-wt)), the isomerization step leads to a significant increase in the content of i-paraffins.

During the conventional hydroisomerisation some cracking may be present. Therefore, the selection of the catalyst and optimization of reaction conditions are always important during the isomerization step. Due to cracking during isomerization, renewable diesel and renewable aviation fuel components may be formed.

Hydroisomerisation can be carried out in a conventional hydroisomerisation unit. Hydrogen is added into the hydroisomerisation step. Both the hydrodeoxygenation step and hydroisomerisation step may be conducted in the same reactor in different reactor beds, or even in the same reactor bed.

As products (and preferably as liquid products), hydrotreatment of the present feedstocks provides various hydrocarbons, preferably paraffinic, more preferably at least partly isoparaffinic hydrocarbons suitable for use in fuel applications. According to an embodiment, the renewable hydrocarbons suitable for use in fuel applications comprise components for renewable diesel, sustainable aviation fuel, renewable gasoline or any combination thereof, preferably at least one or more of renewable diesel component meeting a pre-selected diesel specification (e.g. requirements for EN15490-2018) and sustainable aviation fuel component (e.g. an aviation fuel component meeting a pre-selected aviation fuel specification such as, for example, ASTM D7566-2020 Annex 2).

Chemically the renewable or fossil origin of any organic compounds, including hydrocarbons, can be determined by suitable method for analyzing the content of carbon from renewable sources e.g. DIN 51637 (2014), ASTM D6866 (2020), or EN 16640 (2017). Said methods are based on the fact that carbon atoms of renewable or biological origin comprise a higher number of unstable radiocarbon (14C) atoms compared to carbon atoms of fossil origin. The 14C-isotope content can be used as evidence of the renewable or biological origin of a feedstock, any intermediate or a product. Therefore, it is possible to distinguish between carbon compounds derived from biological sources, and carbon compounds derived from fossil sources by analyzing the ratio of 12C and 14C isotopes. Thus, a particular ratio of said isotopes can be used to identify renewable carbon compounds and differentiate those from non-renewable i.e. fossil carbon compounds. The isotope ratio does not change in the course of chemical reactions. Example of a suitable method for analyzing the content of carbon from biological sources is ASTM D6866 (2020). An example of how to apply ASTM D6866 to determine the renewable content in fuels is provided e.g. in the article of Dijs et al., Radiocarbon, 48(3), 2006, pp 315-323. For the purpose of the present invention, a carbon-containing material, such as a feedstock or product is considered to be of renewable origin if it contains 90% or more modern carbon (pMC), such as about 100% modern carbon, as measured using ASTM D6866.

Figure 4:
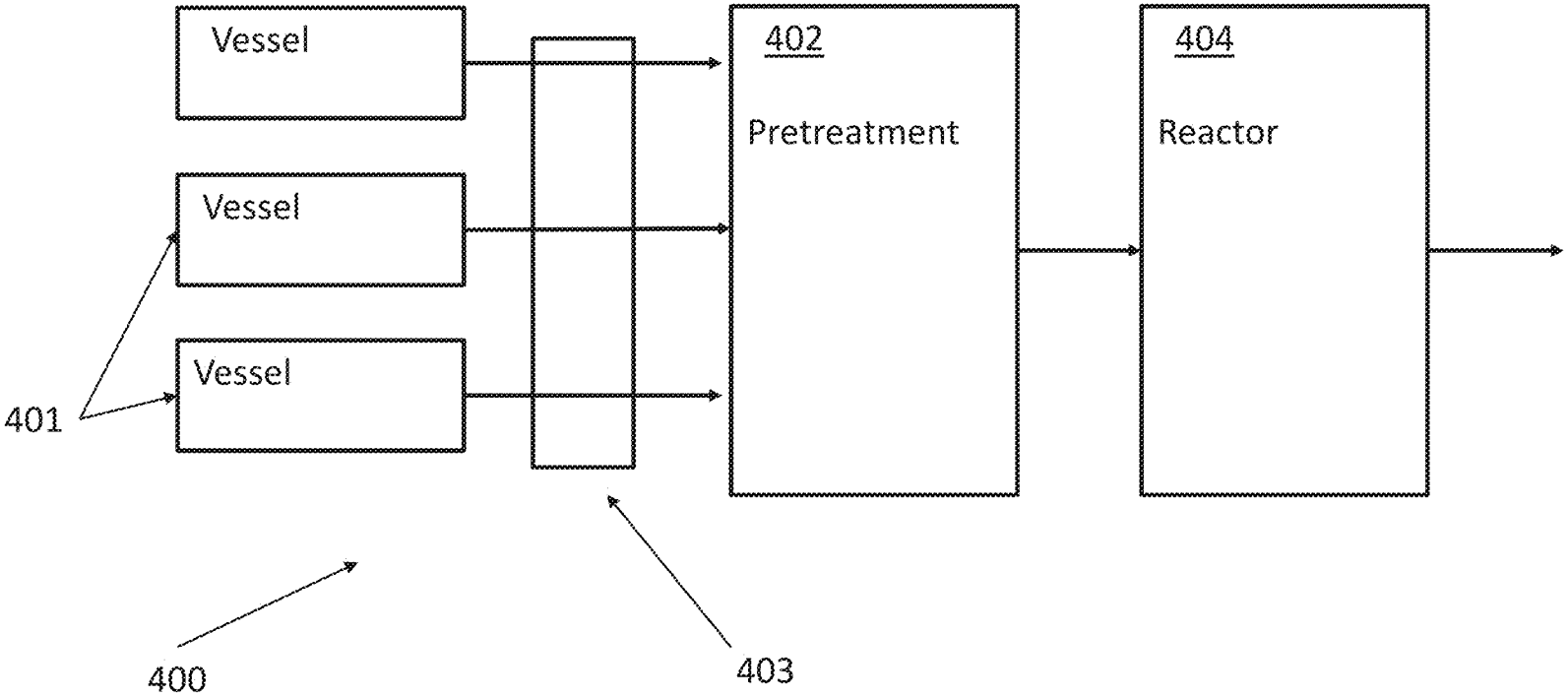
FIG. 4 is a block diagram of an exemplary embodiment of a system for forming hydrocarbons.
Figure 5:
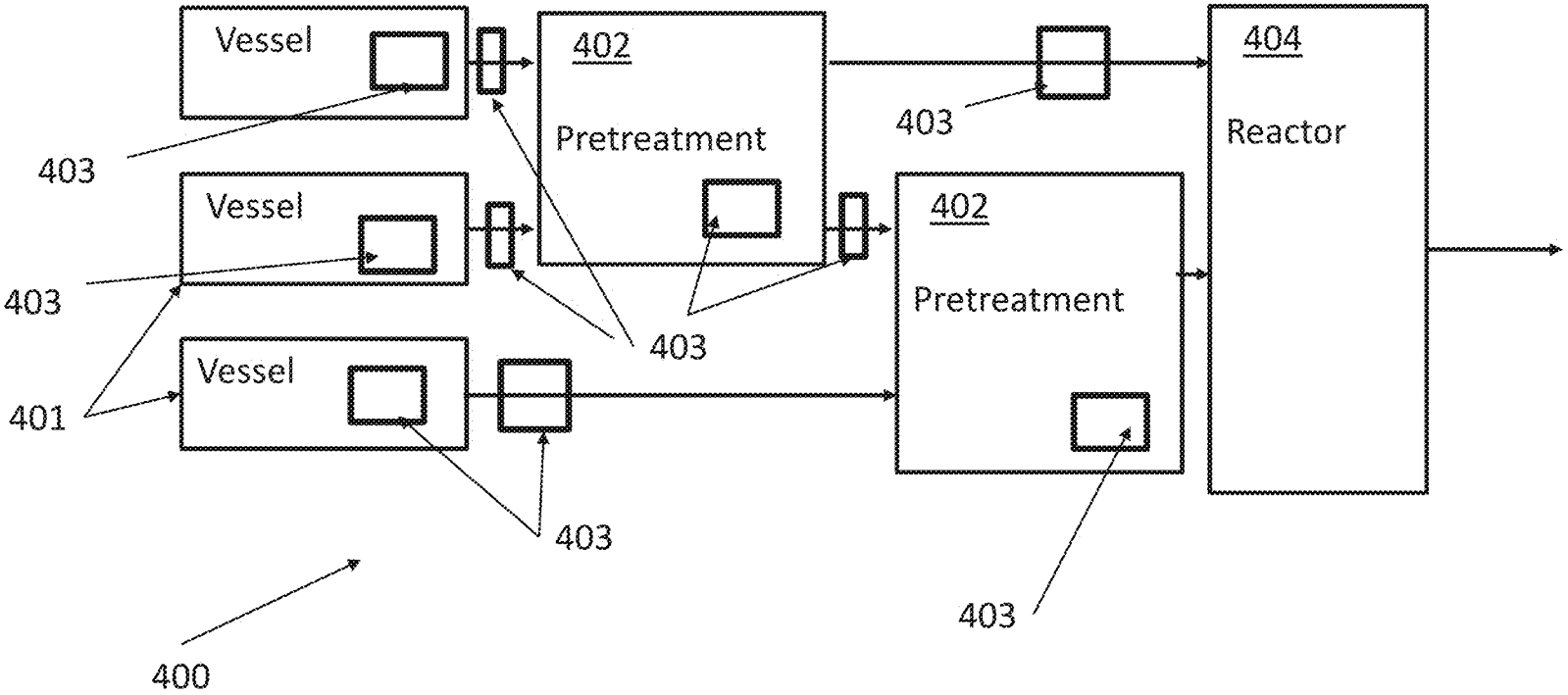
FIG. 5 is a block diagram of another exemplary embodiment of a system for forming hydrocarbons.

A system for preparing or manufacturing hydrocarbons, is also provided. Exemplary embodiment of the system 400 are shown in FIGS. 4 and 5. As can be appreciated from FIGS. 4-5, the system 400 can include at least one vessel 401 for storage of a renewable feedstock comprising lipophilic phosphorus compounds. The system can also include at least one sample extraction mechanism 403 that is configured for extraction of one or more samples of feedstock before the sample(s) are accepted or fed to at least one pretreatment device 402 and/or a hydrotreatment reactor 404. The feedstock from one or more vessels 401 can be fed to at least one pretreatment device 402 to undergo pretreatment prior to being fed to the hydrotreatment reactor 404. The hydrotreatment reactor 404 can be positioned to receive the renewable feedstock from the vessel(s) 401 such that the renewable feedstock fed to the hydrotreatment reactor 404 is subject-able to a hydrotreatment process to form hydrocarbons in a catalytic reaction employing a catalyst. A content of the lipophilic phosphorus compounds in the renewable feedstock subjectable to the hydrotreatment process can be in a range of less than 2 parts per million by weight (wppm) and greater than or equal to 0.1 wppm so that deactivation of the catalyst is reduced or avoided.

As can be appreciated from FIGS. 4-5, one or more sample extraction mechanisms 403 can be positioned at various positions within the system for sample collection and analysis. Samples can be taken before or after any pretreatment device 402 and/or before being fed into the hydrotreatment reactor 404. For instance, some embodiments may utilize a single sample extraction mechanism 403 that can be connected to conduits, vessels 401, and/or pretreatment device(s) 402 for collection of samples for analysis. Other embodiments can utilize multiple sample extraction mechanism 403 that can each be positioned to collect one or more samples from a vessel 401, pretreatment device 402, and/or conduit to which it can be connected.

Each sample extraction mechanism 403 can be configured to extract one or more feedstock samples for analysis. The analysis that is performed can identify aspects of the phosphorus impurity within the feedstock(s) for selection of which pretreatment device(s) 402 to utilize for the feedstock for pretreating the feedstock before it is fed to the hydrotreatment reactor 404 for formation of hydrocarbons. The selected pretreatment device(s) 402 can include at least one pretreatment device 402 positioned between the vessel (s) 401 and the hydrotreatment reactor 404 to pretreat the renewable feedstock(s) of the vessel(s) via at least one pretreatment process to lower the content of the lipophilic phosphorus compounds within the renewable feedstock before the renewable feedstock is passed to the hydrotreatment reactor. For instance, the selected pretreatment processing can include degumming and/or bleaching followed by heat treatment, only application of a heat treatment, only application of degumming and/or bleaching, a blending of multiple feedstocks from multiple vessels prior to undergoing further pretreatment via another pretreatment device 402, or other suitable pretreatment processing as discussed herein for effectively lowering the phosphorus content to within a pre-selected phosphorus content range. For example, the at least one pretreatment device 402 can be configured to perform one or more of: degumming, heat treatment, acid treatment, filtration, bleaching, heat treatment with adsorbent (HTA), and/or blending.

In some embodiments, the system 400 can be configured so that the sample extraction mechanism(s) 403 can extract one or more samples of a renewable feedstock stored in a vessel 401 for evaluating the renewable feedstock before the renewable feedstock is acquired for use in a hydrotreatment process to form hydrocarbons. The extraction and analysis of the one or more samples can be performed to determine a content of lipophilic phosphorus compounds in the renewable feedstock. In response to a determination that the content of the lipophilic phosphorus compounds in the renewable feedstock from one or more of the vessels 401 is greater than a pre-selected lipophilic phosphorus content threshold, the renewable feedstock can be evaluated to determine whether the feedstock is pretreatable to lower the content of the lipophilic phosphorus compounds within the renewable feedstock so the content of the lipophilic phosphorus compounds in the renewable feedstock is in a range of less than 2 parts per million by weight (wppm) and greater than or equal to 0.1 wppm. In response to determining that the renewable feedstock is pretreatable to lower the content of the lipophilic phosphorus compounds in the renewable feedstock to within the range of less than 2 wppm and greater than or equal to 0.1 wppm, the renewable feedstock can be accepted or approved for use in a process to form the hydrocarbons. The accepted or approved feedstock from one or more vessels 401 may then be fed to at least one pretreatment device 402 for pretreatment based on the evaluation of the one or more samples. Thereafter, the pretreated feedstock can be fed to the hydrotreatment reactor 404 for formation of hydrocarbons. Embodiments of the system 400 can be configured so that the pretreatment of the feedstock from the one or more vessels provided via at least one pretreatment device 402 is able to provide a feed for feeding to the hydrotreatment reactor 404 that has a content of the lipophilic phosphorus compounds in the renewable feedstock in a range of between less than 2 wppm and 0.1 wppm so that deactivation of a catalyst used in the hydrotreatment process is reduced or avoided.

In some embodiments, the system 400 can be adapted so that the evaluating of the renewable feedstock before the renewable feedstock is subjected to the hydrotreatment process to determine the content of the lipophilic phosphorus compounds in the renewable feedstock includes an evaluation of multiple feedstocks stored in different vessels 401. For instance, sample(s) from a first vessel having a first feedstock and sample(s) from a second vessel 401 having a second feedstock can be extracted via at least one sample extraction mechanism 403 prior to the feedstocks being accepted or used in a hydrotreatment process. In response to a determination that the content of the lipophilic phosphorus compounds in the first renewable feedstock of the first vessel is greater than a pre-selected lipophilic phosphorus content threshold and in response to a determination that the content of the lipophilic phosphorus compounds in the second renewable feedstock of the second vessel is less than a pre-selected lipophilic phosphorus content threshold, the first and second feedstocks from the first and second vessels can be blended via a pretreatment device 402 to form a blended renewable feedstock so the content of the lipophilic phosphorus compounds in the blended renewable feedstock is lower than the content of the lipophilic phosphorus compounds in the first renewable feedstock and also has a content of lipophilic phosphorus compounds within the formed blended renewable feedstock that is at or below the pre-selected lipophilic phosphorus content threshold or within a pre-selected lipophilic phosphorus content range for a feed for being fed to the hydrotreatment reactor 404. Alternatively (or in combination), the first renewable feedstock of the first vessel 401 can undergo pretreatment via a pretreatment device 402 to lower the content of the lipophilic phosphorus compounds in the feed prior to feeding that first feedstock to the hydrotreatment reactor 404 and/or prior to blending that feedstock with the second feedstock for forming a blended feed for feeding to the reactor.

In yet other embodiments, the vessels 401 can include second and third feedstocks stored therein. The second and third feedstocks can be evaluated or analyzed to determine the content of the lipophilic phosphorus compounds in those feedstocks. In the event that the second or third feedstock has a concentration that exceeds a pre-selected threshold while the other feedstock has a lower concentration, the second and third feedstocks can be pretreated to include blending of the feedstocks so that the lipophilic phosphorus compound content within the blended feedstock is at or below the pre-selected threshold (e.g. between less than 2 wppm and 0.1 wppm, less than or equal to 1.5 wppm, etc.). The blended feedstock that includes the blended second and third feedstocks that may also have optionally undergone other pretreatment based on the analysis of the samples of the second and third feedstocks can be considered a formed first feedstock for feeding to the hydrotreatment reactor 404 to undergo hydrotreatment for formation of hydrocarbons.

The evaluation and analysis of the samples performable via the system can include the different evaluation and analysis methodologies discussed herein. Also, the pretreatment of one or more feedstocks can include any or all of the different pretreatment options discussed herein as may be determined to be suitable to adjust the phosphorus compound content so the phosphorus content within the formed feed that is to be fed to the hydrotreatment reactor 404 is at or below the pre-selected threshold (e.g. between 1.5 wppm and 0.1 wppm, less than 2 wppm, etc.). The selection and use of the different pretreatment options can be based on the evaluation of the samples of the feedstocks obtained and analyzed before those feedstocks are accepted and/or approved for being fed towards a hydrotreatment reactor 404 (and prior to undergoing at least one selected pretreatment via at least one pretreatment device 402).

Some embodiments can be configured so that the sample collection and evaluation can facilitate selection of pretreatment device utilization. In some embodiments (e.g. an embodiment shown in FIG. 5), first and second feeds can be fed to at least one first pretreatment device to undergo at least one first pretreatment (e.g. heat treatment, bleaching and/or degumming). A third feed and the second feedstock output from the at least one first pretreatment device 402 can be fed to a second pretreatment device 402 to undergo at least one second pretreatment that can include blending of the second and third feeds. The blended second and third feeds output from the at least one second pretreatment device 402 can be fed to the reactor 404 as a second pretreated feed that can be to the reactor 404 with the first pretreated renewable feedstock output from the at least one first pretreatment device (or after that first renewable feedstock is fed to the reactor 404 or before that first renewable feedstock is fed to the reactor 404). The conducted pretreatments can be performed so that the renewable feeds fed to the reactor have a lipophilic phosphorus concentration that is within the pre-selected range (e.g. less than 2 wppm, between 1.5 wppm and 0.1 wppm, etc.). The conducted pretreatments that are performed can be selected and used based on analysis of samples extracted via the one or more sample extraction mechanisms 403 to provide the feeds to the reactor 404 that have the lipophilic phosphorus concentration of the pretreated renewable feedstocks within the pre-selected lipophilic phosphorus concentration range.

Embodiments of the system 400 (e.g. systems 400 of FIGS. 4 and 5) can be configured to utilize a first exemplary process for producing renewable hydrocarbons suitable for use in fuel applications from a renewable feedstock comprising at least one or more lipophilic phosphorus compound (s). Embodiments of the process can include:

(i) providing the renewable feedstock, wherein the sum amount of the lipophilic phosphorus compound(s) calculated as elemental phosphorus is more than 2 wppm, preferably from more than 2 wppm to 50 wppm, more than 2 wppm to 30 wppm or from 3-5 wppm to 30 wppm of the feedstock weight;

(ii) subjecting the renewable feedstock to at least one pretreatment to obtain a pretreated renewable feedstock, wherein the sum amount of the lipophilic phosphorus compound(s) calculated as elemental phosphorus is lower than that of the renewable feedstock in step (i), preferably less than 2 wppm, such as less than 1.5 wppm to 0.1 wppm of the pretreated feedstock weight or less than 2 wppm to 0.1 wppm of the pretreated feedstock weight;

(iii) subjecting the pretreated renewable feedstock to at least one catalytic hydrotreating step to obtain the renewable hydrocarbons.

The present inventors have found the amount of at least one or more lipophilic phosphorus compound(s) providing an excellent indicator of the ability of conventional pretreatment method(s) to remove phosphorus from the feedstock. Further, it can be an indicator of the feedstock quality. Yet further, it can indicate whether the feedstock is safe and ready to be fed to hydrotreatment catalyst or whether pretreatment(s) to lowers said lipophilic phosphorus compound(s) content is needed for being suitable for directing into hydrotreatment without unduly deactivating the catalyst and/or shortening the HDO catalyst life. In addition to keeping the lipophilic phosphorous at a pre-selected range that can be selected for feeds to be determined to be suitable for directing into hydrotreatment without unduly deactivating the catalyst and/or shortening the HDO catalyst life, the overall phosphorus content of the feed can also be provided at a total phosphorous content that is at a reasonable level (e.g. the overall phosphorus content may also be within a pre-selected range or below a pre-selected threshold and this threshold or range may be greater than the range or threshold that is selected for the lipophilic phosphorous content).

As to the sum amount of the lipophilic phosphorus compound(s) in the renewable feedstock, embodiments have proven to provide significant results in lowering the catalyst deactivating compounds when the sum amount of the lipophilic phosphorus compound(s) calculated as elemental phosphorus is more than 1 wppm, however, typically more than 2 wppm, such as from greater than 2 wppm to 100 wppm, from greater than 2 wppm to 100 wppm, or from 3-5 wppm to 50 wppm of the total feedstock weight before the feedstock has undergone pretreatment. In cases where the sum amount of the lipophilic phosphorus compound(s) calculated as elemental phosphorus is only slightly more than 1 wppm, such as from 1 wppm to 2 wppm, the sum amount of the lipophilic phosphorus compound(s) in the pretreated renewable feedstock can be lower than that of the feed renewable feedstock prior to it undergoing pretreatment, then preferably less than 1 wppm, such as from 1 wppm to 0.1 wppm of the pretreated feedstock weight can include lipophilic phosphorus. Renewable feedstocks having a sum amount, or cumulative sum amount, of the lipophilic phosphorus compound(s) calculated as elemental phosphorus of more than 50 wppm are of very low quality and therefore can be considered either unsuitable for hydrotreatment processing (e.g. be rejected so such feeds are not used) or be identified as needing heavier treatments for purification that may need substantial and extensive pretreatment processing.

Typically, one pretreatment can be sufficient when selected based on information on the lipophilic phosphorus compound content therein obtained via analysis of one or more samples of the feedstock(s) that form the feed to be fed to the hydrotreatment rector 404. However, according to an embodiment, two or more feedstock pretreatments can be conducted in sequence in step (ii). A combination of two or more pretreatments may be needed in cases where the amount of lipophilic phosphorus compound(s) is exceptionally high or the lipophilic phosphorus compounds comprise several compound types responding differently to the pretreatments in the renewable feedstock before any treatment (s), for example. For instance, renewable feedstocks having a cumulative sum amount of the lipophilic phosphorus compound(s) calculated as elemental phosphorus of more than 50 wppm are of very low quality and can require heavier pretreatments for purification (numerous pretreatments etc.).

In step (ii), the sum amount of the lipophilic phosphorus compound(s) calculated as elemental phosphorus in the pretreated renewable feedstock weight is lower than that of the renewable feedstock in step (i). Preferably the sum amount of the lipophilic phosphorus compound(s) calculated as elemental phosphorus in the pretreated renewable feedstock weight is less than 2 wppm of the pretreated renewable feedstock weight, such as from 2 wppm to 0.1 wppm of the pretreated renewable feedstock weight, less than 2 wppm to 0.2 wppm of the pretreated renewable feedstock weight, less than 2 wppm to 0.3 wppm of the pretreated renewable feedstock weight or less than 2 wppm to 0.4 wppm of the pretreated renewable feedstock weight or is less than 1.5 wppm of the pretreated renewable feedstock weight, such as from 1.5 wppm to 0.1 wppm of the pretreated renewable feedstock weight, 1.5 wppm to 0.2 wppm of the pretreated renewable feedstock weight, 1.5 wppm to 0.3 wppm of the pretreated renewable feedstock weight, or 1.5 wppm to 0.4 wppm of the pretreated renewable feedstock weight. Feeds having a sum amount of the lipophilic phosphorus compound(s) of more than 2 wppm may ruin the catalyst activity within months leading to costly downtime and need for catalyst regeneration. Present experiments have shown attractively low sum amounts of the lipophilic phosphorus compound(s), such as less than 2 wppm (Example 4) being obtainable by pretreatment sequence of heat treatment followed by bleaching for several animal fat samples where the sum amount of lipophilic phosphorus compounds in the feedstock initially varied roughly from about 5 wppm to about 25 wppm.

For a feedstock, a wide range of pretreatments with a great variety of modifications can be available in the field. According to preferred embodiments, the feedstock pretreatment is, or the pretreatments are, selected from degumming, heat treatment, heat treatment with adsorbent (HTA), acid treatment, filtration, bleaching, blending or any combination thereof. With the present process for selecting a pretreatment based on determining the amount of the lipophilic phosphorus compound(s), the hydrotreatment catalysts may be best protected against deactivation and the catalyst life extended. Further, excessive pretreatments, which unavoidably lead to increased processing cost and yield loss, can be prevented. Selection of the pretreatment(s) can be dependent on feed composition, the impurity profile, type of impurities present in the feed, and/or other fctors. For example, for specific feedstocks, heat treatment was found to remove lipophilic phosphorus compounds efficiently from the feedstocks, but in some other cases it might be redundant should the analyses reveal that of the total phosphorus content, only a marginal portion is of lipophilic phosphorus. Hence, performing the necessary but only the necessary pretreatments can lead to a more effective and economic process.

In one embodiment the pretreatment can be selected from heat treatment optionally followed by evaporation of volatiles, whereby the feedstock is heated at a temperature of from 80° C. to 325° C., preferably 180° C. to 300° C., and more preferably 200° C. to 280° C., in a residence time from 1 min. to 300 min. The heat treatment can be followed by an evaporation step, where especially silicon and phosphorus containing compounds are removed. An example of heat treatment of a feedstock comprising organic material can be found in WO 2020/016405. Heat treatment can also be followed by filtration as an addition or an alternative to evaporation. When the feedstock comprises brown grease or acidulated soapstock, the pretreatment can include heat treatment with or without filter-aid (adsorbent) may be used followed by filtration and possible bleaching.

In one embodiment the pretreatment can be selected from heat treatment with adsorbent (HTA) optionally followed by flash evaporation. HTA as pretreatment can be especially suitable when the feedstock comprises CTO and/or TOP, but also for other feedstock. Heat treatment with adsorbent (HTA) can be performed in a temperature from 180° C. to 325° C., preferably from 200° C. to 300° C., more preferably from 240° C. to 280° C., optionally in the presence of an acid. The adsorbent can be selected from alumina silicate, silica gel and mixtures thereof and is typically added in an amount of 0.1 wt. % to 10 wt. %, such as 0.5 wt. %. An example of HTA can be found in WO 2020/016410, the entirety of which is incorporated by reference herein. Heat treatment with adsorbent (HTA) can also be referred to as high temperature adsorption, heat treatment with adsorption, or heat treating in the presence of adsorbent (e.g. in the presence of at least one adsorbent material, in the presence of at least one adsorbent, etc.).

In one embodiment the pretreatment is selected from bleaching. Bleaching can be conducted by acid addition in an amount of from 500 to 5000 ppm based on feed. The bleaching treatment can be performed in a temperature from 60° C. to 90° C. and including a drying step in 110° C. to 130° C. at a reduced pressure. The bleaching is finished by a filtration step to remove formed solids and possible filter aids. In one example bleaching includes the following sequence:

(1) acid addition at 1000-4000 parts per million (ppm) citric acid (50% aqueous solution) 85° C., 10 min;
(2) adsorbent/Titter aid addition at 0.1-1 wt. %, 85° C., 800 mbar, 20 min.;
(3) drying at 120° C., 80 mbar, 25 min.
(4) filtering at 120° C., 2.5 bar.

Both heat treatment (HT) and heat treatment with adsorbent (HTA) can be performed under pressure, the pressure can be 10 kPa to 5,000 kPa (e.g. a pressure between 150 kPa to 800 kPa, etc.). Also, water can be added before or during HT and HTA to a level of up to 5 wt. %, such as 1 wt. %-3 wt. %. The evaporation, e.g. performed by flashing can be performed after HT or HTA or any other pretreatment stage and can be performed at about 160° C., such as from 150° C. to 225° C., in a pressure of 10 mbar to 100 mbar (1 kPa to 10 kPa).

For a feedstock comprising palm oil mill effluent sludge (POME) the pretreatment can comprise acid degumming followed by solid removal from the liquid, using filtration or centrifugation. The degumming process can further be followed by a bleaching step.

In one embodiment of the invention the pretreatment, comprises heat treatment (HT) followed by bleaching.

In one embodiment of the invention the pretreatment, comprises heat treatment (HT) with alkali addition and bleaching.

In one embodiment of the invention the pretreatment, comprises heat treatment with adsorption (HTA) followed by flash (removal of light components comprising Si components etc. by evaporation) and bleaching, In addition, the pretreatment may or may not include additional steps such as removal of solids (using technologies such as centrifugation or filtration) before and/or after HT or HTA, water washing, degumming, hydrolysis, distillation, strong acid treatment, second or further bleaching or any combination of the mentioned methods. The pretreatment can also include blending. The blending can be performed prior to and/or after one or more other pretreatments (e.g. blending before HT or HTA, and/or blending after HT or HTA, etc.).

In a preferred embodiment, bleaching can be a last step of a pretreatment sequence. In such an embodiment, the bleaching can be considered as polishing treatment leaving the pretreated feed ready for one or more hydrotreatment steps. However, bleaching alone cannot remove high impurity levels from very dirty feedstocks.

In one embodiment of the invention the pretreatment, comprises blending the feedstock with a second feedstock having a sum amount of lipophilic phosphorus compound(s) which is lower than that of the feedstock to be treated. Blending can be performed in a sequence of pretreatment so that at least one instance of blending occurs prior to other pretreatments. However, blending can also, or alternatively, take place elsewhere in a sequence of pretreatment steps (e.g. be performed as a second or third pretreatment, etc.). To be able to calculate appropriate blend proportions, the sum amount of lipophilic phosphorus compound(s) can be analyzed from both the feedstock to be treated and the second feedstock. Analyzing total phosphorus content may be insufficient because it may not accurately reflect the content of lipophilic phosphorus within the feed that can significantly affect pretreatment effectiveness as discussed herein.

According to a specific embodiment, the combination of pretreatments can consist of a combination of blending and heat treatment, preferably in said sequence. The combination of pretreatments can also consist of a combination of heat treatment and blending in this sequence. The combination of heat treatment and blending in this order can be beneficial in case the heat treatment capacity is limiting the overall process volume, for example. The heat treatment can be HT or HTA in such embodiments. Heat treatment has been found to provide promising results in the experiments conducted with analysis on the lipophilic phosphorus compounds and with some pretreatment methods applied.

For instance, according to another specific embodiment, the combination of pretreatments can consist of combination of heat treatment with absorbent (HTA) and blending, preferably in said sequence. The combination of HTA and blending in this order may be beneficial in case the process capacity for the HTA is limited and could limit the overall process volume, for example.

According to an embodiment, at least one pretreatment step can be selected based on data on the pretreatment's capability on reducing the sum amount of the lipophilic phosphorus compound(s) in a feedstock; and subjecting the renewable feedstock to at least one pretreatment thereby selected. Such data may be previously obtained from experiments or full-scale runs where the lipophilic phosphorus compounds have been analyzed from both the feedstock and the pretreated feedstock. It should be appreciated that the data on which the pretreatment selection is based can be obtained from experiments or full-scale runs where the lipophilic phosphorus compounds have been analyzed, (e.g. from both the feedstock and from the pretreated feedstock).

For the present experiment, an analysis method was developed. It was found that instead of or further to analyzing the total phosphorus content, a specific analysis on the lipophilic fraction provided most relevant information for the pretreatment selection. Hence, according to an embodiment, determining the sum amount of the lipophilic phosphorus compound(s) is conducted by an analysis comprising separating from a sample at least one fraction containing the lipophilic phosphorus compound(s), and analyzing said fraction to provide data on the sum amount of the lipophilic phosphorus compounds in said renewable feedstock or said pretreated renewable feedstock. In practice, the analysis can typically be conducted to a sample collected from said feedstock, pretreated feedstock, any intermediate between pretreatments and/or a combination thereof. However, collecting a sample may be replaced or include any means, such as microchip or like providing corresponding analysis result for the feedstock.

Further to the fraction containing the lipophilic phosphorus compound(s), preferably said analysis comprises collecting at least one amphiphilic fraction. Collecting these two fractions (e.g. an amphiphilic fraction and a lipophilic fraction) with the aid of an appropriate solvent system, can contribute to more specific analysis.

According to an embodiment, said separating comprises solid phase extraction (SPE) or flash chromatography, In the present experiments discussed herein SPE proved efficient for use. As noted herein, however, other separating processes can alternatively be used.

According to an embodiment, the SPE can comprise use of a solvent system, preferably wherein the extraction is made with a set of solvents with increasing polarity of solvents in the solvent system.

According to an embodiment, the phosphorus content in the separated fraction can be analyzed by a quantitative mass spectrometry analysis, preferably an inductively coupled plasma mass spectrometry analysis (coupled ICP-MS).

Embodiments of the system 400 can also be configured for utilization of another process. For instance, embodiments of the system 400 can be configured for utilization of a process for separation and analysis of phosphorus content within a feedstock for use in catalytic production of renewable hydrocarbons to provide data on at least one lipophilic phosphorus compound(s) in a renewable feedstock. This utilization can include selection of at least one pretreatment capable of reducing the lipophilic phosphorus compound(s) content based on the separation and analysis (e.g. which can be facilitated via at least one sample extraction mechanism 403) and subjecting the renewable feedstock to the selected pretreatment processing via at least one pretreatment device 402 to provide a pretreated renewable feedstock.

According to an embodiment, the sum amount of the lipophilic phosphorus compound(s) calculated as elemental phosphorus is less than 2 wppm of the pretreated renewable feedstock weight., such as from less than 2 wppm to 0.1 wppm of the pretreated renewable feedstock weight, or less than 1.5 wppm, such as from less than 1.5 wppm to 0.1 wppm of the pretreated renewable feedstock weight.

According to an embodiment, the separation and an analysis comprises steps of:

(a) collecting at least one sample of said renewable feedstock containing one or more lipophilic phosphorus compound(s);
(b) separating from said sample at least one fraction containing the lipophilic phosphorus compound(s), and
(c) analyzing said fraction to provide data on a sum amount of the at least one lipophilic phosphorus compound in said renewable feedstock.

According to an embodiment, said separating in step (ii) comprises solid phase extraction (SPE) or flash chromatography, preferably SPE.

The sum amount of the at least one lipophilic phosphorus compound in said renewable feedstock can be a cumulative sum amount of all the lipophilic phosphorus compound in said renewable feedstock.

According to an embodiment, the use further comprises subjecting the pretreated renewable feedstock to at least one catalytic hydrotreating to obtain renewable hydrocarbons.

According to an embodiment said separation and said analysis in catalytic production of renewable hydrocarbons to provide data on at least one lipophilic phosphorus compound(s) in a renewable feedstock are used for reducing the loss of hydrotreatment catalyst activity.

EXAMPLES

The following examples are provided to better illustrate the claimed invention. They are not to be interpreted as limiting the scope of the invention, which is determined by the claims. To the extent that specific materials are mentioned, it is merely for purposes of illustration and is not intended to limit the invention. One skilled in the art may develop equivalent means or reactants without exercising inventive capacity and without departing from the scope of the invention. It shall be understood that many variations can be made in the procedures described herein while remaining within the scope of the present invention. All exemplary materials and parameters used in the examples below are compatible with the embodiments of the system, embodiments of the method and embodiments of products.

The present experiments describe a method for extraction and quantification of lipophilic phosphorus from renewable feedstocks. An automated solid phase extraction (SPE) based method was developed for CombiFlash NextGen 300+ system (Teledyne ISCO) which is equipped with four solvent inlet ports, an evaporative light scattering (ELS) and UV-vis detectors. It can be coupled with various types and sizes of commercial separation columns prior to the detection.

In this disclosure, a 24 g gold grade silica column was used as stationary phase, and heptane, iso-propanol, methanol, and their mixtures were used as solvents of increasing polarity (mobile phase) for fractional extraction. The lipophilic and amphiphilic fractions can be determined based on the ELS detector, and their amounts can be quantified by weight after the removal (by rotavapor) of solvents. The method can be used for determining the lipophilic content in lipid-based feedstocks as well as pretreated products thereof, e.g. bleaching products, aging products.

Example 1:—Identifying Samples with High Lipophilic Phosphorus Compounds Content Seven bio-oil samples were analyzed for their total phosphorus content (e.g. using ICP-MS/NIS with microwave degradation of sample prior to analysis) and further analyzed for their content of lipophilic phosphorus compound(s) according to the disclosed. SPE method.

The results showed that most of these feeds contained 1-2 wppm of lipophilic phosphorus and that the lipophilic phosphorus usually constituted <10% of the total phosphorus concentration. However, 1 brown grease sample was found to have a very high lipophilic phosphorus content (27 wppm, corresponding to 23 weight percent (%-wt) of the total phosphorus), suggesting serious challenges for catalytic hydroprocessing and for the feed purification typically used pretreatments such as degumming or bleaching. Brown grease is known as a very challenging lipid feed class, an explanation for which in relation to the phosphorus compounds was confirmed in this analysis and can be seen in Table 1.

Analysis results providing total phosphorus content (P tot (wppm)), lipophilic phosphorus compound content (Lipophilic P (wppm)) and the share of the lipophilic phosphorus compound content of the total phosphorus content as a percentage are given in Table 1.

TABLE 1

Analysis results for seven lipid feed examples as to their phosphorus contents.

| Feed | P tot (wppm) | Lipophilic P (wppm) | Lipophilic P Within P tot |
|---|---|---|---|
| Animal fat | 110 | 1.6 | 1% |
| Used cooking oil | 15 | 1.5 | 10% |
| Brown grease | 120 | 27 | 23% |
| Technical corn oil | 30 | 1.6 | 5% |
| Vegetable acid oil | 170 | 1.7 | 1% |
| Tall oil pitch | 35 | 2.6 | 7% |
| Crude tall oil | 20 | 1.5 | 8% |

As seen from the above Table 1, the total phosphorus content (P tot) varies from 15 to 170 wppm, being highest for vegetable acid oil and lowest for used cooking oil. However, despite their different total phosphorus contents, their content of lipophilic phosphorus (Lipophilic P) is close to one another with the exception of the brown grease.

Further, even though the total phosphorus contents of animal fat and brown grease seem relatively similar (110 wppm and 120 wppm), from the point of view of the catalyst life-time, their effect is very different. This is because after e.g. common degumming pretreatment, the brown grease would thus have a much more detrimental impact the catalyst lifetime than the animal fat. From the last column, it can be seen how the proportions of the lipophilic phosphorus compounds in relation to the total phosphorus content vary in different samples.

Example 2: Further Feed Samples

Further samples were analyzed by the same method showing even greater variability between the different samples. They were measured from real-life feed samples. Even though they could be classified based on their origin (plant or animal) and refining process, the variation between samples of the same class revealed their true character and unpredictability as waste and residue materials. The analyzed lipophilic phosphorus compound contents for samples of used cooking oil (UCO), palm oil mill effluent (POW), animal fat (AF), brown grease (BG), combinations thereof and/or bleaching products (BL) thereof, are given in Table 2. Based on the analysis results, such as those presented in table 2, feeds requiring pretreatment, such as blending, can be spotted. Further, an appropriate blending partner can be selected based on such analysis results. Knowledge on sum amount of the lipophilic phosphorus compounds in a sample can enable calculations required for pretreatment by blending and/or optionally selection of conditions for other pretreatments or pretreatment sequences.

The analyzed lipophilic phosphorus compound contents are given in Table 2, which identify a total phosphorus content (Total P) with the sample, a lipophilic phosphorus content (Lipophilic P) within the sample, and a lipophilic phosphorus content of the overall total phosphorus (Lipophilic P Within Total P). Based on the analysis results in Table 2, an appropriate blending partner can be selected as discussed herein.

TABLE 2

Further lipophilic phosphorus content results from different feedstock samples.

| Sample Type | Total P (wppm) | Lipophilic P conc (wppm) | Lipophilic P Within Total P |
|---|---|---|---|
| UCO | 9.6 | 0.8 | 8.0% |
| UCO | 7.7 | 1.5 | 19.0% |
| UCO | 11.0 | 3.6 | 33.0% |
| UCO | 13.0 | 2.0 | 15.0% |
| UCO | 17.0 | 2.0 | 12.0% |
| POME | 15.0 | 3.0 | 20.0% |
| POME | 4.0 | 0.6 | 15.0% |
| POME | 2.5 | 0.9 | 36.0% |
| UCO(10)-AF(90) | 35.0 | 0.8 | 2.0% |
| UCO(10)-AF(90) | 34.0 | 1.0 | 3.0% |
| UCO(10)-AF(90) | 39.0 | 0.9 | 2.0% |
| UCO-BL | 2.3 | 0.8 | 36.0% |
| UCO-BL | 3.9 | 2.5 | 65.0% |
| UCO-BL | 1.9 | 0.9 | 46.0% |
| UCO-BL | 5.2 | 1.6 | 30.0% |
| UCO-BL | 12.0 | 2.3 | 19.0% |
| UCO-BL | 2.4 | 1.6 | 65.0% |
| UCO(10)-AF(90)-BL | 2.7 | 1.1 | 41.0% |
| UCO(10)-AF(90)-BL | 1.9 | 1.4 | 76.0% |
| UCO(10)-AF(90)-BL | 2.2 | 1.1 | 52.0% |
| BG-BL | 8.7 | 1.5 | 18.0% |
| AF-BL | 1.0 | 0.6 | 62.0% |
| POME-BL | 16.0 | 0.9 | 6.0% |
| POME-BL | 7.8 | 1.1 | 14.0% |

The above results identified in Table 2 indicate the variability of phosphorus impurity contents that can be included in a feedstock. Lipophilic phosphorus, which may be more difficult to remove via pretreatment, can surprisingly make up a large portion of the overall phosphorus content within a feed that can make it unsuitable for effective pretreatment for subsequent use in hydrotreatment. Identification of this condition can allow for a more effective feed selection and/or pretreatment selection. For example, pretreatment via blending can be employed for high lipophilic phosphorus content feedstock to help lower the overall lyophilic phosphorus content within a feed prior to that feed being fed to a hydrotreatment process. The reduction of the lipophilic phosphorus within the overall phosphorus content can help allow the feed to be within a pre-selected phosphorus content range and also within a pre-selected lipophilic phosphorus range (e.g. less than 2 wppm lipophilic phosphorus, between less than 2 wppm lipophilic phosphorus and 0.1 wppm lipophilic phosphorus, between 1.5 wppm lipophilic phosphorus and 0.1 wppm lipophilic phosphorus, etc.). Further, a suitable pretreatment scheme that can help provide the desired phosphorus content for the feed can be selected to provide a desired lipophilic phosphorus content within a feed in a more efficient manner so that feed within the pre-selected lipophilic phosphorus content threshold can be more routinely provided for hydrotreatment. This can help avoid (or at least reduce) catalyst deactivation and extend the life of the hydrotreatment catalyst.

Example 3: Removal of Phosphorus Model Compounds with Various Degree of Lipophilicity Four commercially available phosphorus compounds with different lipophilicity were purchased: tri-octyl-phosphine (A), tri-octyl-phosphine oxide (B), 18:0 lyso phosphoglycerol (C) and octadecyl-phosphonic acid (D), in order of decreasing lipophilicity. Sample compounds for these available phosphorus compounds A, B, C, and D are shown below:

A

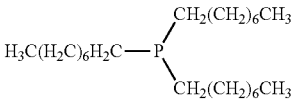

C

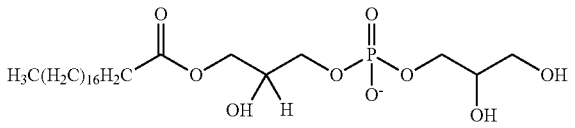

B

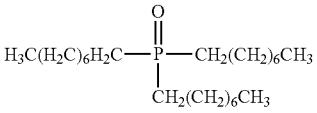

D

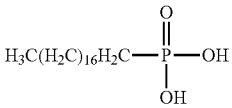

Samples were prepared by spiking a purified vegetable oil with the above noted four model compounds (A, B, C, D). In SPE separation, the first two compounds were found to elute in the lipophilic fraction, whereas the octadecyl-phosphonic acid and the 18:0 lyso phosphoglycerol eluted later in the amphiphilic fractions. FIG. 1 shows separation into lipophilic phosphorus phase (A and B) and amphiphilic phosphorus phase (C and D) of the model compounds in the present SPE method. Hence, the results verified the separation efficiency for lipophilic phosphorus of the SPE method.

Figure 2:
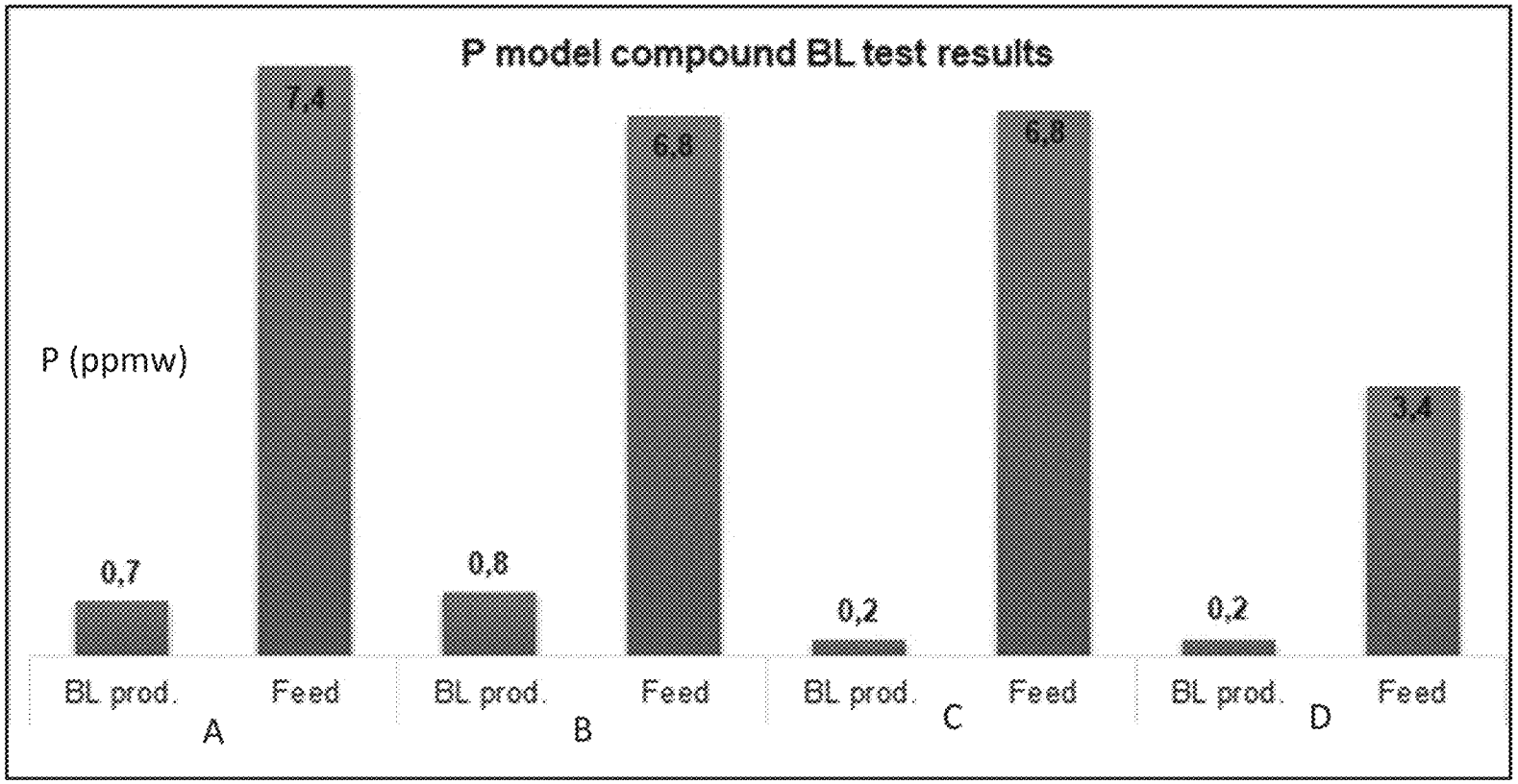
FIG. 2 shows Lipophilic (A and B) and amphiphilic (C and D) model compound bleaching results. It should be appreciated that the number formatting in FIG. 2 utilizes a Finnish format (e.g. 0,7 instead of 0.7, 7,4 instead of 7.4, 0,8 instead of 0.8, 6,8 instead of 6.8, 0,2 instead of 0.2, and 3,4 instead of 3.4, etc.).

The results were connected to purification of lipid oils by pretreatments. Samples containing the respective model compound were prepared to correspond to elemental phosphorus concentration ~7 wppm. Samples were then bleached (2.5 wt-% dosage of acidic mineral adsorbent). For the two lipophilic compounds (the phosphine and the phosphine oxide), the model solution phosphorus concentration after bleaching was reduced to 0.8 wppm again corresponding to elemental phosphorus. For the amphiphilic phosphorus compounds, the phosphorus content in the bleaching product was 0.2 wppm, demonstrating how amphiphilic impurities are easier removed from lipid matrices by surface chemistry reactions than lipophilic impurities. Lipophilic (A and B) and amphiphilic (C and D) model compound bleaching results are also given in FIG. 2.

In this example the concentration of phosphorus compounds was modest and the adsorbent dosage high, which explains the relatively good purification of the lipophilic phosphorus. As seen in the example, bleaching (including adsorption as key phenomena) can remove moderate amounts of lipophilic phosphorus, but at excessively high adsorbent cost.

Example 4: Choice of Suitable Pretreatment to Minimize Lipophilic Phosphorus in Animal Fat Samples Three samples of filtered animal fat were bleached and the residual phosphorus (total phosphorus) in the bleaching product was analyzed (results shown in the below Table 3). Performing a heat treatment of the animal fat effectively mitigated the impact of lipophilic phosphorus compounds therein, in that the heat-treated animal fat could be bleached to low residual phosphorus concentration, tentatively due to the heat degradation of both phospholipids or their lipophilic derivatives. The example demonstrated how using the detected lipophilic phosphorus concentration in feed samples may be used to choose effective pretreatment methods for improved effectiveness at reliably removing phosphorus from a feedstock to avoid or reduce catalyst deactivation that can enhance the lifetime of the catalyst.

The heat treatment (HT) was performed by heating 600 g of the feed in a 1 L stirred autoclave reactor from Parr Instruments, under stirring of 500 revolutions per minute (rpm). The feed was heated to 280° C. (balance pressure) and kept at 280° C. for 30 min before cooling to about 60° C. In this laboratory experiment, the heating time was 30 min and the cooling time 20 min, with a reaction time of 30 min after heating and before cooling. The treatment severity corresponded roughly to 45 min treatment at 280° C. in a tube reactor setup. The heat treated product was bleached. The citric acid (2000 mg'kg of swas added at 85° C. followed by mixing, 1 wt-% of bleaching earth was added, mixed, and the sample was dried with vacuum and filtered at 105° C. The conditions were the same in all bleaching tests. Some of the non-heat treated feeds were also subjected to bleaching as a comparison.

TABLE 3

Residual phosphorus concentration in bleached samples. Bleaching of samples was done with 1 wt-% dosage of acidic mineral adsorbent.

| Sample | Filtered and bleached feed (wppm) | Heat treated and bleached (wppm) |
|---|---|---|
| Animal fat 1 | 8.4 | 1.7 |
| Animal fat 2 | 16.8 | 0.7 |
| Animal fat 3 | 23.5 | 1.3 |

The results of Example 4 shown in Table 3 indicate that filtering and bleaching did not remove the P (total) to a relatively high purity, and the residual phosphorus is expected to be a lipophilic phosphorus type that is the difficult to remove phosphorus. We believe this is the case because, as previously discussed above, the lipophilic P is not well removed by degumming or bleaching, which are dependent on the amphiphilic character of phosphorus impurities to be removed. Also, example 2 shows that in general, the lipophilic P forms a high portion of the total P in bleaching products (due to its low removal rate in bleaching, compared to the other P impurities), and that in general, the lipophilic P is a lower portion of the total P in untreated feeds The results shown in Table 3 above show that the use of heat treatment with bleaching as a combination of pretreatments on the sampled feeds was able to effectively remove the lipophilic phosphorus as well as have the overall phosphorus removed to a preferred concentration level. In contrast, filtering and bleaching was unable to provide such effective removal of phosphorus. As discussed above, we believe this is due to the high lipophilic phosphorus content within those samples.

Heat treatment in combination with bleaching was able to provide a reduction in phosphorus that was 78.8% higher in the removal of phosphorus as compared to the filtering and bleaching for the Animal fat 1 sample. For the Animal fat 2 sample, heat treatment in combination with bleaching was able to provide a reduction in phosphorus that was 95.8% higher in the removal of phosphorus as compared to the filtering and bleaching. For the Animal fat 3 sample, heat treatment in combination with bleaching was able to provide a reduction in phosphorus that was 95.5% higher in the removal of phosphorus as compared to the filtering and bleaching.

These results from Example 4 show that the combination of heat treatment and bleaching can yield an excellent purification result. This helps show that analyzing lipophilic phosphorus content can provide relevant information for the selection of pretreatment for a lipid feed (e.g. a bio oil feedstock, a renewable feedstock, etc.).

Example 5: Solid Phase Extraction (SPE) Details

Figure 3:
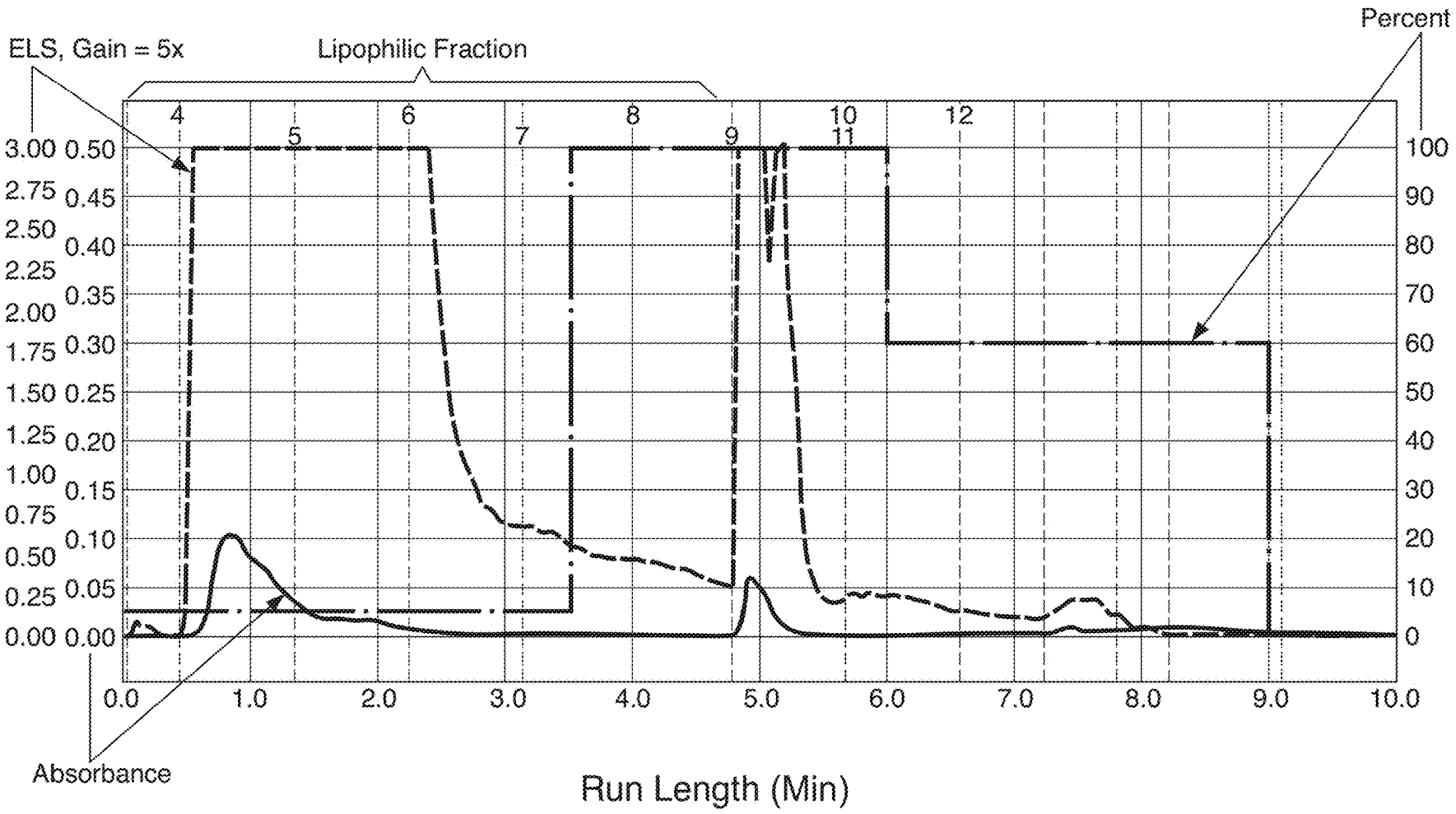
FIG. 3 shows a separation result by SPE of a used cooking oil (UCO) sample.

Solid phase extraction (SPE) method was also developed for the lipophilic phosphorus analytics. An example chromatogram from this SPE method is provided in FIG. 3. The SPE process used in this Example 5 is described below.

Samples were melted in a 60° C. oven for 10-15 min. 2.00±0.10 g of sample was transferred with glass pipette into a 20 mL vial and mixed with 2 mL of n-heptane to dissolve the sample. Sample vial was placed in a warm water bath at 50° C. for 2-3 min and shaken well prior to the injection to the SPE column.

Analytical grade n-heptane, iso-propanol, and methanol from VWR were used as a solvent in all analyses as received.

The SPE instrument used was CombiFlash NextGen 300+ equipped with a single use 24 g silica gold column from Teledyne. The method settings used were, liquid sample loading type, solvent flow rate of 45 mL/min, evaporative light scattering detector, UV detector wavelength 1-275 nm, UV detector wavelength 2-385 nm. Solvent gradients were indicated in chromatogram with 0-3.5 min (95% n-Heptane, 5% iso-propanol), 3.5-6 min (100% iso-propanol), 6-9 min (60% methanol, 40% iso-propanol), 9-10 min (100% n-Heptane). The lipophilic (0-4.7 min, tube 1-8) and amphiphilic (4.7-12 min, tube 9+) fractions were collected in pre-weighted 500 mL round bottom flasks, and the solvents were evaporated using a rotary evaporation system according to the system manual. Lipophilic and amphiphilic fractions were weighted after the removal of solvents, and the total phosphorus content in lipophilic fractions were measured by an ICP-MS/MS method.

The foregoing description has provided by way of non-limiting examples of particular implementations and embodiments a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed example embodiments may be used to advantage without the corresponding use of other features. As such, the foregoing description shall be considered as merely illustrative of the principles of the present invention, and not in limitation thereof. Hence, the scope of the invention is only restricted by the appended patent claims. Therefore, while certain exemplary embodiments and methods of making and using the same have been discussed and illustrated herein, it is to be distinctly understood that the invention is not limited thereto but may be otherwise variously embodied and practiced within the scope of the following claims.

What is claimed is:

1. A method for preparing hydrocarbons, the method comprising:

evaluating a renewable feedstock before the renewable feedstock is subjected to a hydrotreatment process to determine a content of lipophilic phosphorus compounds in the renewable feedstock; and in response to a determination that the content of the lipophilic phosphorus compounds in the renewable feedstock is greater than a pre-selected lipophilic phosphorus content threshold, pretreating the renewable feedstock via at least one pretreatment process to lower the content of the lipophilic phosphorus compounds within the renewable feedstock so the content of the lipophilic phosphorus compounds in the renewable feedstock is less than 2 parts per million by weight (wppm) and greater than or equal to 0.1 wppm;

subjecting the renewable feedstock to the hydrotreatment process to form hydrocarbons from the renewable feedstock;

wherein a content of the lipophilic phosphorus compounds in the renewable feedstock subjected to the hydrotreatment process is in a range of between less than 2 wppm and 0.1 wppm so that deactivation of a catalyst used in the hydrotreatment process is reduced or avoided.

2. The method of claim 1, wherein the content of the lipophilic phosphorus compounds in the renewable feedstock subjected to the hydrotreatment process is less than 1.5 wppm and greater than or equal to 0.1 wppm.

3. The method of claim 1, wherein the at least one pretreatment process includes degumming, heat treatment, acid treatment, filtration, bleaching, heat treatment with adsorbent (HTA), blending or any combination thereof.

4. The method of claim 1, wherein the pretreating of the renewable feedstock comprises:

blending the renewable feedstock with at least one second renewable feedstock to form a blended renewable feedstock so the content of the lipophilic phosphorus compounds in the blended renewable feedstock is lower than the content of the lipophilic phosphorus compounds in the renewable feedstock and is at or below the pre-selected lipophilic phosphorus content threshold; and/or pretreating the blended renewable feedstock to lower the content of the lipophilic phosphorus compounds therein.

5. The method of claim 1, comprising:

analyzing the content of the lipophilic phosphorus compounds in the renewable feedstock.

6. The method of claim 5, wherein the analyzing of the content of the lipophilic phosphorus compounds in the renewable feedstock comprises:

collecting at least one sample of the renewable feedstock;

separating from the sample at least one fraction including the lipophilic phosphorus compounds, and analyzing the at least one fraction to provide data on the content of the lipophilic phosphorus compounds in the renewable feedstock.

7. The method of claim 6, wherein the separating from the sample at least one fraction including the lipophilic phosphorus compounds comprises solid phase extraction (SPE), the separating from the sample being performed such that at least one amphiphilic fraction is also collected; and the SPE comprises use of a solvent system such that a polarity of solvents in the solvent system increases during the SPE.

8. The method of claim 7, wherein the analyzing of the at least one fraction including the lipophilic phosphorus compounds comprises at least one of:

a quantitative analysis to provide quantitative data on lipophilic phosphorus compounds;

a quantitative mass spectrometry analysis, and/or an inductively coupled plasma mass spectrometry analysis.

9. The method of claim 1, comprising:

in response to a determination that the content of the lipophilic phosphorus compounds in the renewable feedstock is greater than a pre-selected lipophilic phosphorus content threshold, selecting the at least one pretreatment process to pretreat the renewable feedstock to lower the content of the lipophilic phosphorus compounds within the renewable feedstock, the selecting being based on results from the evaluating of the renewable feedstock.

10. The method of claim 1, wherein the hydrotreatment process includes one or more of hydrodeoxygenation, hydrodecarboxylation, hydrodecarbonylation, hydroisomerisation and hydrocracking.

11. The method of claim 1, wherein the renewable feedstock is formed from at least one renewable source, the at least one renewable source includes one or more of:

rapeseed oil, colza oil, canola oil, tall oil, sunflower oil, soybean oil, hempseed oil, cottonseed oil, corn oil, olive oil, linseed oil, mustard oil, palm oil, peanut oil, castor oil, coconut oil, camellia oil, jatropha oil, an oil derived from a microbial source, animal fat, fish oil, lard, tallow, train oil, oil derived from bacteria, oil derived from mold, oil derived from filamentous fungi, recycled fat from at least one industrial food source, and a mixture thereof.

12. A method for selecting a renewable feedstock for use in forming hydrocarbons, the method comprising:

evaluating the renewable feedstock before the renewable feedstock acquired for use in a hydrotreatment process to form the hydrocarbons, the evaluating being performed to determine a content of lipophilic phosphorus compounds in the renewable feedstock;

in response to a determination that the content of the lipophilic phosphorus compounds in the renewable feedstock is greater than a pre-selected lipophilic phosphorus content threshold, evaluating whether the renewable feedstock is pretreatable to lower the content of the lipophilic phosphorus compounds within the renewable feedstock so the content of the lipophilic phosphorus compounds in the renewable feedstock is in a range of less than 2 parts per million by weight (wppm) and greater than or equal to 0.1 wppm, in response to determining that the renewable feedstock is pretreatable to lower the content of the lipophilic phosphorus compounds in the renewable feedstock to within the range of less than 2 wppm and greater than or equal to 0.1 wppm, accepting or acquiring the renewable feedstock for use in a process to form the hydrocarbons.

13. The method of claim 12, comprising:

pretreating the renewable feedstock via one or more of: degumming, heat treatment, acid treatment, filtration, bleaching, heat treatment with adsorbent (HTA), blending or any combination thereof.

14. The method of claim 12, wherein the evaluated renewable feedstock is a first renewable feedstock, the method also comprising:

evaluating a second renewable feedstock before the first renewable feedstock is subjected to a hydrotreatment process to determine a content of lipophilic phosphorus compounds in the second renewable feedstock;

in response to a determination that the content of the lipophilic phosphorus compounds in the second renewable feedstock is less than a pre-selected lipophilic phosphorus content threshold, performing at least one of:

blending the second renewable feedstock with the first renewable feedstock to form a blended renewable feedstock so the content of the lipophilic phosphorus compounds in the blended renewable feedstock is lower than the content of the lipophilic phosphorus compounds of the first renewable feedstock and the content of the lipophilic phosphorus compounds in the blended renewable feedstock is at or below the pre-selected lipophilic phosphorus content threshold for forming a hydrotreatment feed to feed to a hydrotreatment process; or pretreating the first renewable feedstock to lower the content of the lipophilic phosphorus compounds therein for subsequent blending with the second renewable feedstock for forming a hydrotreatment feed to feed to a hydrotreatment process, the hydrotreatment feed having a content of the lipophilic phosphorus compounds therein that is at or below the pre-selected lipophilic phosphorus content threshold.

15. The method of claim 14, wherein the pretreating of the first renewable feedstock comprises degumming, heat treatment, acid treatment, filtration, bleaching, heat treatment with adsorbent (HTA), or any combination thereof.

16. The method of claim 12, wherein the evaluating the renewable feedstock comprises:

analyzing the content of the lipophilic phosphorus compounds in the renewable feedstock, the analyzing comprising:

collecting at least one sample of the renewable feedstock;

separating from the sample at least one fraction including the lipophilic phosphorus compounds, the separating from the sample at least one fraction including the lipophilic phosphorus compounds including solid phase extraction (SPE), the separating from the sample being performed such that at least one amphiphilic fraction is also collected, and the SPE comprises use of a solvent system such that a polarity of solvents in the solvent system increases during the SPE and analyzing the at least one fraction to provide data on the content of the lipophilic phosphorus compounds in the renewable feedstock, the analyzing of the at least one fraction including at least one of:

a quantitative analysis to provide quantitative data on the lipophilic phosphorus compounds;

a quantitative mass spectrometry analysis, and/or an inductively coupled plasma mass spectrometry analysis.

* * * * *